US009290853B2

(12) United States Patent
Elgammal et al.

(10) Patent No.: US 9,290,853 B2
(45) Date of Patent: Mar. 22, 2016

(54) ELECTROLYTIC GENERATION OF GRAPHITE

(71) Applicant: Saratoga Energy Research Partners, LLC, Orinda, CA (US)

(72) Inventors: Ramez A. Elgammal, Berkeley, CA (US); Franck Samuel Germain Falgairette, Pierrelatte (FR); Drew L. Reid, San Francisco, CA (US); Kenneth Reid, Piedmont, CA (US)

(73) Assignee: Saratoga Energy Research Partners, LLC, Orinda, CA (US)

( * ) Notice: Subject to any disclaimer, the term of this patent is extended or adjusted under 35 U.S.C. 154(b) by 188 days.

(21) Appl. No.: 13/950,055

(22) Filed: Jul. 24, 2013

(65) Prior Publication Data

US 2014/0202874 A1 Jul. 24, 2014

Related U.S. Application Data

(60) Provisional application No. 61/755,349, filed on Jan. 22, 2013.

(51) Int. Cl.

| | |
|---|---|
| ***C25B 9/00*** | (2006.01) |
| ***C25B 15/02*** | (2006.01) |
| ***C25B 3/00*** | (2006.01) |
| ***C25D 17/00*** | (2006.01) |
| ***C25D 17/12*** | (2006.01) |
| ***C25B 15/08*** | (2006.01) |
| ***C25B 1/00*** | (2006.01) |

(52) U.S. Cl.
CPC .. *C25B 15/08* (2013.01); *C25B 1/00* (2013.01)

(58) Field of Classification Search
CPC ..... C25B 9/00; C25B 15/02; C25B 11/02; C25B 3/00; C25D 17/00; C25D 17/12
USPC ..... 204/234, 242
See application file for complete search history.

(56) References Cited

U.S. PATENT DOCUMENTS

| | | | | |
|---|---|---|---|---|
| 4,028,199 | A * | 6/1977 | Holland | 205/575 |
| 4,609,451 | A | 9/1986 | Sammells et al. | |
| 5,618,392 | A * | 4/1997 | Furuya | 204/252 |

(Continued)

FOREIGN PATENT DOCUMENTS

| | | |
|---|---|---|
| EP | 1361194 | 11/2003 |

OTHER PUBLICATIONS

Ingram, M. D., et al., "The Electrolytic Deposition of Carbon from Fused Carbonates," *Electrochimica Acta*, 1966, 11, 1620-1639.

(Continued)

*Primary Examiner* — Zulmariam Mendez
(74) *Attorney, Agent, or Firm* — Weaver Austin Villeneuve & Sampson LLP

(57) ABSTRACT

The embodiments herein relate to methods and apparatus for forming graphitic material from a carbon oxide feedstock in an electroplating chamber containing molten inorganic carbonate as electrolyte. Carbon dioxide flows into a reaction chamber containing one or more cathodes, one or more anodes, and a molten carbonate electrolyte. The carbon dioxide and/or carbonate reduces at the cathode to form graphitic material, which may be removed from the surface of the cathode through various mechanisms. The graphitic material is then separated out from the electrolyte.

32 Claims, 13 Drawing Sheets

(56) References Cited

U.S. PATENT DOCUMENTS

| | | | | |
|---|---|---|---|---|
| 6,435,130 | B1 * | 8/2002 | Takaki | C23C 16/24 118/723 E |
| 2004/0108200 | A1 * | 6/2004 | Des Jardins | C25C 1/00 204/228.6 |
| 2011/0100832 | A1 | 5/2011 | Lubomirsky et al. | |

OTHER PUBLICATIONS

Kaplan, B., et al., "Synthesis and Structural Characterization of Carbon Powder by Electrolytic Reduction of Molten $Li_2CO_3$—$Na_2CO_3$—$K_2CO_3$," *Journal of the Electrochemical Society*, 2002, 149, D72-D78.

Groult, H., et al., "Preparation of Carbon Nanoparticles from Electrolysis of Molten Carbonates and Use as Anode Materials in Lithium-Ion Batteries," *Solid State Ionics*, 2006, 177, 869-875.

Le Van, K., et al., "Electrochemical Formation of Carbon Nano-Powders with Various Porosities in Molten Alkali Carbonates," *Electrochimica Acta*, 2009, 54, 4566-4573.

Kaplan, V., et al., "Conversion of $CO_2$ to CO by Electrolysis of Molten Lithium Carbonate," *Journal of the Electrochemical Society*, 2010, 157, B552-B556.

Kamali, A.R., et al., "Effect of the Graphite Electrode Material on the Characteristics of Molten Salt Electrolytically Produced Carbon Nanomaterials," *Materials Characterization*, 2011, 62, 987-994.

Yin, H. Y. et al., "Capture and Electrochemical Conversion of $CO_2$ to Value-Added Carbon and Oxygen by Molten Salt Electrolysis," *Energy & Environmental Science*, 2013, 6, 1538-1545.

* cited by examiner

ELECTROLYTIC GENERATION OF GRAPHITE

CROSS-REFERENCE TO RELATED APPLICATION

This application claims the benefit of priority under 35 U.S.C. §119(e) to U.S. Provisional Application 61/755,349, titled "ELECTROLYTIC GENERATION OF GRAPHITE," filed Jan. 22, 2013, all of which is incorporated herein in its entirety by this reference.

BACKGROUND

Graphite is a form of crystalline carbon. The carbon atoms within graphite are densely arranged in parallel-stacked, planar, honeycomb-lattice sheets. Graphite is a soft mineral which exhibits perfect basal cleavage. It is flexible but not elastic, has a low specific gravity, is highly refractory, and has a melting point of 3,927° C. Of the non-metals, graphite is the most thermally and electrically conductive, and it is chemically inert. These properties make graphite beneficial for numerous applications in a range of fields.

Worldwide demand for graphite has increased in recent years, and is expected to continue to increase as global economic conditions improve and more graphite-using non-carbon energy applications are developed.

Some examples of the uses of graphite include use as a steel component, static and dynamic seals, low-current, long-life batteries (particularly lithium ion batteries), rubber, powder metallurgy, porosity-enhancing inert fillers, valve and stem packing, and solid carbon shapes. Graphite is also used in the manufacture of supercapacitors and ultracapacitors, catalyst supports, antistatic plastics, electromagnetic interference shielding, electrostatic paint and powder coatings, conductive plastics and rubbers, high-voltage power cable conductive shields, semiconductive cable compounds, and membrane switches and resistors.

In recent years, graphite has been important in the emerging non-carbon energy sector, and it has been used in several new energy applications such as in pebbles for modular nuclear reactors and in high-strength composites for wind, tide and wave turbines. Graphite has also been used in energy storage applications such as bipolar plates for fuel cells and flow batteries, anodes for lithium-ion batteries, electrodes for supercapacitors, phase change heat storage, solar boilers, and high-strength composites for flywheels. Furthermore, graphite is used in energy management applications such as high-performance polystyrene thermal insulation and silicon heat dissipation. The new and increasing demand from these energy applications may require double the current graphite supply when fully implemented, and current graphite capacity may not be adequate to meet this rising demand.

U.S. production of synthetic graphite in 2011 was estimated to be about 148,000 metric tons valued at over $1 billion.

The current dominant approach for producing synthetic graphite is a time-consuming multi-step process including the phases of (1) powder preparation, (2) shape forming, (3) baking, and (4) graphitization.

In the powder preparation step, raw materials such as petroleum coke are pulverized in crushers and ball mills. The resulting powder is conditioned according to the particle size distribution using screening or sieving. Petroleum coke usually contains about 10-20% volatile components such as water and other volatile organic matter which must be removed before the petroleum coke is suitable for manufacturing graphite. These volatile components are removed through the calcining process, which involves heating the coke to a sufficiently high temperature to volatize, vaporize, or burn off all volatile components. The sieved, calcined powder is then blended with a binder such as coal tar pitch, petroleum pitch or synthetic resins.

In the shape forming step, the carbon powder mixed with binder is compacted through a shape forming technique such as cold isostatic pressing, extrusion or die molding. Cold isostatic pressing involves applying pressure from multiple directions through a liquid medium surrounding the compacted part, and the process generally takes place at room temperature. Extrusion involves forcing the mixture through a die with an opening, resulting in a long product with a regular cross-section such as rods, bars, long plates and pipes, which can be cut to the desired length. Die molding involves placing the powder in a die between two rigid punches and applying uniaxial pressure to the powder to compact it.

During the baking step, the compacted parts are heat treated in a baking furnace at 1000-1200° C. for 1-2 months in the absence of air. The baking process is also known as carbonization, and it results in the thermal decomposition of the binder into elementary carbon and volatile components.

Lastly, in the graphitization step, the baked parts are heat treated in an Acheson furnace at 2500-3000° C. The high temperatures present in this step require the exclusion of oxygen from the furnace, accomplished by covering the carbon particles with some type of oxygen scavenging material such as petroleum coke or metallurgical coke. The graphitization step generally takes two to three weeks, resulting in a typical overall processing time of around 1.5-3 months for the conventional method of producing synthetic graphite.

The quality of the graphite produced through this conventional method is correlated with the quality of the petroleum coke feedstock, whose price is linked to the price of oil.

SUMMARY

The techniques described herein relate to methods and apparatus for producing carbon. In one aspect of the disclosed embodiments, a method of producing carbon is provided, including reducing a precursor including carbon dioxide and/or carbonate ion to solid carbon by contacting the precursor with a cathode in an electrochemical cell containing a molten inorganic carbonate as electrolyte; removing the solid carbon from the cathode, where the solid carbon forms a mixture with the electrolyte; and separating the solid carbon from the electrolyte.

In various embodiments, the solid carbon is graphitic material. In some cases, the method also includes obtaining carbon dioxide from a combustion reaction. The combustion reaction may be conducted at an energy generating facility. In some cases, the carbon dioxide is dissolved in the electrolyte. The carbonate in the electrolyte may be selected from the group consisting of lithium carbonate, sodium carbonate, potassium carbonate and mixtures thereof. In a particular embodiment, the carbonate is lithium carbonate. The reduction of carbon dioxide may produce soluble oxide anion which is oxidized at an anode in the electrochemical cell.

In some cases, the electrolyte is circulated through a recirculation loop attached to the electrochemical cell. In these cases, separating the solid carbon from the electrolyte may include passing the electrolyte-carbon mixture through a liquid-solid separator in the recirculation loop.

There are numerous possible mechanisms for removing the solid carbon from the cathode. In some embodiments, removing the solid carbon from the cathode includes vibrating the cathode. For example, the cathode may vibrate at approximately the resonance frequency of the cathode. Removing the solid carbon from the cathode may also include vibrating the electrolyte. In certain cases, removing the solid carbon from the cathode includes scraping the cathode with a scraping mechanism. In one embodiment, scraping the cathode is performed while the cathode rotates with respect to the scraping mechanism. The timing of carbon removal may vary between different embodiments. In some cases, the solid carbon may be removed from the one or more cathodes while continuing to reduce the precursor at one or more other cathodes. In some embodiments, the solid carbon is removed from the one or more cathodes while continuing to reduce the precursor at the one or more cathodes from which solid carbon is being removed.

The solid carbon in the electrolyte may include particles having an average diameter or principal dimension of between about 0.1 micrometers and 1000 micrometers. The method may also include reacting carbon dioxide with a metal oxide in the electrolyte to generate carbonate ion.

In another aspect of the disclosed embodiments, an apparatus for producing solid carbon from carbon dioxide is provided, including (a) an electrochemical cell including a cell chamber for holding a molten carbonate electrolyte during electrochemical reduction of carbon dioxide; one or more cathode assemblies, each comprising a cathode and a mechanism for removing the solid carbon electrochemically deposited on the cathode; and one or more anodes; and (b) a recirculation loop fluidically coupled to the electrochemical cell and including a pump for inducing flow of the electrolyte to and from the electrochemical cell via the recirculation loop; and a liquid-solid separator for separating the solid carbon from the electrolyte.

In certain embodiments, the anode is shaped such that it includes side walls and a bottom that define a reaction space. In these or other cases, the anode may include nickel, nickel oxide, rhodium, graphite, gold, platinum, stainless steel, titanium, tin oxide, or a combination thereof. Further, the anode may include holes and/or slits in the anode to promote removal of evolved gas.

The cathode may be patterned in some implementations. For example, the cathode may include a template for desired graphite formation. The cathode may also be porous. In some embodiments, the cathode includes a material from the group consisting of graphite, titanium, stainless steel, silver, gold, platinum, molybdenum, and a combination thereof. The apparatus may also include a gas diffusion mechanism to promote delivery of carbon dioxide to the cathode.

In some cases, the mechanism for removing the solid carbon from the cathode includes a vibration inducing mechanism for inducing the cathode to vibrate at approximately the resonance frequency of the cathode. In these or other embodiments, the mechanism for removing the solid carbon from the cathode includes a vibration inducing mechanism for inducing the electrolyte to vibrate. Further, the mechanism for removing the solid carbon from the cathode may include a scraper configured to scrape material from the cathode. For example, in some implementations, the mechanism includes a rotator configured to rotate the cathode while the scraper scrapes material from the cathode.

The apparatus may also include a power supply for delivering electrical power to the anode and/or the cathode to drive reduction of carbon dioxide to the solid carbon at the cathode. In some cases, the recirculation loop also includes an electrolyte reservoir.

DETAILED DESCRIPTION

I. Introduction and Overview

Figure 1:
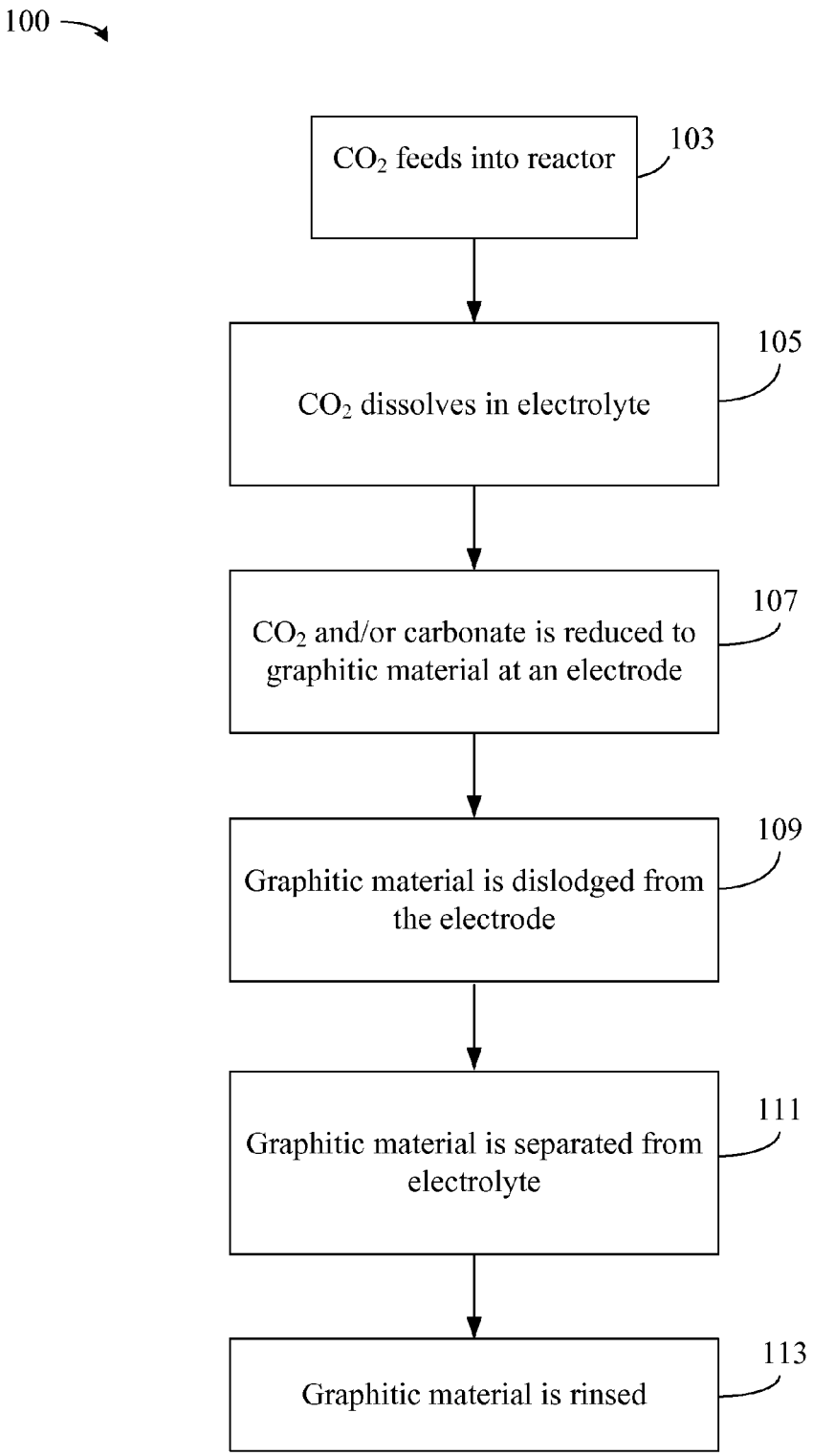
FIG. 1 shows a flowchart depicting a method of forming graphite according to a disclosed embodiment.

In certain implementations, the embodiments disclosed herein provide improved methods of generating graphitic material from carbon dioxide ($CO_2$). Carbon dioxide is a widely available raw material and its release into the atmosphere is responsible for environmental degradation. The extensive burning of fossil fuels for generating electricity and other industrial processes results in the release of large amounts of greenhouse gases such as carbon dioxide, thereby increasing the concentration of $CO_2$ in the atmosphere. There is a growing consensus among the scientific community that the increasing concentration of $CO_2$ in the atmosphere is contributing to global warming. The consequences of global warming include melting of polar ice caps, rising sea levels, endangering coastal communities, threatening arctic and other ecosystems, and increasingly frequent extreme weather events such as heat spells, droughts and hurricanes. Thus, there exists a need for methods which provide for the sequestration of $CO_2$ generated from the burning of fossil fuels and other industrial applications. The resulting graphitic material may be used in a variety of contexts. In one example, the resulting carbon nanomaterial may be used as an anode material in lithium-ion batteries. In another example, the resulting carbon nanomaterial may be used to produce ultracapacitors.

In various embodiments, an electrochemical system includes a reactor and associated electrolyte recirculation loop. The reactor produces graphitic material from carbon dioxide/carbonate feedstock. For the sake of simplicity, the graphitic material may be referred to herein as graphite, despite the fact that the graphitic material may contain mixed phase of carbon, including but not limited to graphite, amorphous carbon, carbon nanotubes, and graphene. The cathode of the reactor reduces carbon dioxide and/or carbonate to graphitic carbon. In various embodiments, the reduction produces oxide anion as a byproduct. Typically, the carbon dioxide dissolves in the electrolyte. The electrolyte may be a molten carbonate or other similar molten salt in which carbon dioxide is soluble. In some cases, the carbon dioxide reacts with metal oxide or with oxide anion in the electrolyte to form carbonate anions ($CO_3^{2}$) in the electrolyte. These carbonate anions, and any carbonate anions already present in the electrolyte may themselves react at the cathode to produce graphite. The reaction taking place at the anode is oxidation of oxide anion to molecular oxygen; for example, $2O^{2-} \leftrightarrow O_2+4\ e-$ The graphite as formed at the cathode may coat and adhere to the cathode. Therefore, the apparatus may employ a mechanism to dislodge or otherwise separate the graphite from the cathode. In some cases, this mechanism vibrates or otherwise agitates the positive electrode with sufficient energy to shear the graphite from the electrode. In one example, the mechanism vibrates the cathode at or near its resonance frequency. In other implementations, the mechanism vibrates the electrolyte through sonication. Operated in these manners, deposited graphite dislodges from the electrode and forms a suspension in the electrolyte. In another approach, the cathode is scraped continuously or periodically to remove deposited graphite. In some cases, the cathode rotates or otherwise moves with respect to a fixed position scraper. In other embodiments, a scraper moves with respect to a fixed position cathode.

In many designs, the reactor includes a recirculation loop for circulating the electrolyte from electrochemical cell through a liquid/solid separator and then back to the cell. The separator separates suspended graphite from the liquid electrolyte. A slurry pump may be provided in the recirculation loop to draw electrolyte from the electrochemical cell and through the liquid/solid separator.

II. Electrochemical Reactions

1. Cathode Reaction

At the cathode, one or more carbon-containing reactants are reduced to form graphitic material. The carbon-containing reactants may include carbon oxides (typically carbon dioxide) and/or carbonate. The carbon dioxide may be reduced to form solid graphite and soluble oxide ion according to the following reaction:

$$CO_2+4e- \leftrightarrow C(s)+2O^{2-}$$

The $CO_2$ is typically dissolved in the electrolyte, although in some implementations it may be provided in gas phase at the electrode surface. In configurations using a carbon dioxide in the gas phase, a gas collection electrode may be used as the cathode, or in conjunction with it, to bring $CO_2$ to the interface of the electrode and electrolyte.

Additionally or alternatively, carbonate ions may react at the cathode to form graphite according to the following reaction:

$$CO_3^{2-}+4e- \leftrightarrow C(s)+3/2O_2$$

The carbonate ion may originate from the electrolyte directly (e.g., as part of the bulk electrolyte provided before or during electrolysis). Alternatively or additionally, the carbonate ion may be formed through the reaction of dissolved carbon dioxide with oxide ion in the molten electrolyte. The oxide ion may be present in the electrolyte due to the reduction of carbon dioxide and/or carbonate ion at the cathode surface. Carbonate ions diffuse through molten carbonate salt significantly faster (e.g., about 1000 times faster) than $CO_2$ diffuses through this same medium. As such, under certain conditions the reaction at the cathode may be largely controlled by the amount of carbonate ions present. Further, the consumption of $CO_2$ at the cathode will be highest where gas is directly introduced to the cathode. $CO_2$ diffusion may be encouraged by incorporating a gas diffusion component into the cathode (e.g., a gas diffusion electrode or a gas diffusion delivery system used in conjunction with the cathode).

Other carbonaceous reaction products besides graphite may be produced in certain designs. For example, under proper electrolytic deposition conditions other forms of elemental carbon may be produced such as graphene or fullerenes.

2. Anode Reaction

In various embodiments, elemental oxygen ($O_2$) evolves at the anode. As mentioned, oxide anion is produced at the cathode through direct reduction of carbon dioxide or reduction of carbonate anion. The anode reaction may be represented as follows:

$$2O^{2-} \leftrightarrow O_2+4e-$$

It is possible that the evolved oxygen gas could interfere with the efficient reaction of oxide at the positive electrode. Oxygen gas forms high resistance regions which reduce the anode surface area available for electrochemical reaction of oxide anion. As a consequence, certain implementations employ designs that allow the anodic evolution of oxygen in a manner that minimizes the formation or collection of bubbles, thus minimizing voltage drops through the electrolyte. Such designs will be described in more detail below.

Another reaction which may occur at the anode is the formation of carbonate ion from carbon dioxide and oxide anion according to the following reaction:

$$CO_2+O^{2-} \leftrightarrow CO_3^{2-}$$

This reaction may help replenish carbonate ion in the electrolyte.

III. Carbon Feedstock and Product for the Reaction.

The feedstock will contain an oxidized form of carbon used to support the reduction reaction taking place at the cathode. Such feedstocks may include carbon dioxide and/or carbon monoxide. Carbon dioxide is particularly cheap, abundant, and safe.

In certain embodiments, the carbon dioxide feedstock is provided from exhaust gas generated at a power plant or other location where fossil fuels are combusted. Carbon dioxide is also produced as a byproduct of petroleum generation, particularly in enhanced recovery techniques for generating petroleum. Such techniques may include gas injection such as carbon dioxide injection into oil wells. In some cases, the petroleum deposits are associated with carbon dioxide pockets which are released as a part of the oil recovery process. Carbon dioxide is also produced as a byproduct of coal gasification processes.

Typically, the feedstock contains at least about 60 percent carbon dioxide and/or other carbon oxides (as measured by the molar concentration in the feedstock). The remaining gas may be air, nitrogen, water vapor, etc. In some cases, it will be necessary to treat the carbon oxide containing feedstock before delivering it to the cathode. Such treatments include, optionally, removal of water vapor, removal of nitrogen-containing oxides (NOX), removal of sulfur-containing oxides (SOX), and concentration of carbon dioxide. Techniques for concentrating carbon dioxide include, but are not limited to, the use of amine scrubbers, oxyfuels/oxycombustion (pre-combustion technique), hydrocarbon gasification (pre-combustion technique), oxyfuels and fuel cells in combination, minerals and zeolites, sodium hydroxide, lithium hydroxide, metal oxides, and activated carbon.

Carbon Produced at the Cathode

The anode reaction may be controlled to produce graphitic material having a desired set of properties. For some applications, a highly or moderately crystalline graphite is desirable. Graphite crystallinity is typically measured in terms of the crystallite height, which is effectively a measure of the number of graphene sheets stacked on one another in a crystallite. In other words, it is a measure of the z-direction height of a crystallite—assuming that the x and y directions are in the plane of a graphene sheet. Naturally occurring graphite has a crystallite height of approximately 200 to 300 nanometers. Commonly produced synthetic graphite has a crystallite height of approximately 10 to 180 nanometers. The crystallite height produced using methods described herein may have a height of about 50 to 500 nanometers, depending on the desired use of the graphite. In some cases, a highly crystalline form of graphite—one resembling naturally occurring graphite—is produced. In such cases, the crystalline height may be about 150 to 300 nanometers.

To control crystallinity, one may design the apparatus to control the electrochemical deposition conditions at the cathode, the rate or frequency at which graphite is removed from the cathode, and/or the surface conditions of the cathode.

In certain embodiments, the surface of the cathode is designed to provide a morphological "template" promoting a desired level of crystallinity. In some embodiments, the cathode surface contains a carbide to act as a template. Example carbides include, but are not limited to, titanium carbide, iron carbide, chromium carbide, manganese carbide, silicon carbide, nickel carbide, and molybdenum carbide. The species of carbide chosen for a certain application may depend on various factors including the desired qualities of the graphite and the properties of the cathode itself. In some embodiments, the cathode surface contains graphite. The carbide, graphite, or other "template" surface may be provided as a thin continuous layer, a discontinuous layer, or as a monolithic structure that sometimes comprises the entire electrode. In certain embodiments where a thin layer is used, the layer has a thickness of about 1 to 500 nanometers. The thin layer is provided on an appropriately electrically conductive substrate such as stainless steel or titanium.

In certain embodiments, the electrode is porous. In such embodiments, the electrode may have a porosity of between about 0 and 0.7 for example. Porous electrodes have a relatively high surface area per unit volume, thereby promoting relatively high mass deposition rates within the electrochemical cell (as compared to non-porous electrodes). In certain embodiments, the electrode surface is made relatively rough. A rough electrode surface provides nucleation sites (protrusions) to facilitate initiation of the graphite deposition reaction and facilitate uniform deposition over the electrode surface. In some implementations, the surface roughness (Ra) is between about 10 and 1000 micrometers.

The carbon or graphite particles or flakes present in the electrolyte (and separated therefrom) typically have a principal dimension (longest linear dimension) of about 0.1 to 1000 micrometers. The principal dimension is the particle diameter, assuming generally spherical particles.

While the embodiments described herein have focused on deposition of graphitic carbon, other reaction products besides graphite may be produced in certain embodiments. For example, other forms of elemental carbon such as carbon black, graphene, amorphous carbon, activated carbons, carbon nanotubes, and fullerenes may be produced.

IV. Electrolyte

The electrolyte is typically a molten salt such as an alkali metal carbonate. Lithium carbonate is one example. Other examples include sodium carbonate and potassium carbonate. Some electrolytes are made from mixtures of two or more of these carbonates. In some cases, the electrolyte contains between about 30 and 75% by mass lithium carbonate. In one example, the electrolyte contains about 40 to 60% by mass lithium carbonate. Other electrolyte components may include conductivity enhancing additives such as metal chlorides. Example metal chlorides include, but are not limited to, lithium chloride, sodium chloride and potassium chloride. The metal chlorides may also be helpful in controlling the melting point of the electrolyte. In alternative embodiments, the electrolyte is an ionic liquid. Example ionic liquids include, but are not limited to, 1-Ethyl-3-methylimidazolium tetrafluoroborate (EMIM-$BF_4$) and counter-anion derivatives thereof, $PF_6$, halides, pseudohalides, and alkyl substituted imidazolium salts. Although certain ionic liquids may be functionally appropriate for use as the electrolyte, their use may be limited by other considerations such as cost.

The electrolyte should remain in a molten liquid state. Because typical electrolyte materials (e.g., alkali metal carbonates) are solid at room temperature, a relatively high temperature should be employed, although typically below about 900° C. In certain embodiments, an electrolyte temperature of about 450° C. to 900° C. is maintained. In other embodiments, an electrolyte temperature of about 500° C. to 750° C. is maintained. Where an ionic liquid-based electrolyte is used, the electrolyte may be maintained at a lower temperature, for example, between about 25° C. to 300° C., or between about 100° C. to about 250° C. The temperature should not be so high that it aggressively degrades the components of the reactor, including the electrodes.

In certain embodiments where a carbonate-based electrolyte is used, the electrolyte has a viscosity between about 20 and 300 centipoise without taking into account the presence of carbon particles in the electrolyte. In certain embodiments, the electrolyte viscosity is between about 20-100 centipoise. The viscosity of the molten carbonate/graphite slurry may be between about 30-1000 centipoise in certain embodiments. The viscosity of the molten carbonate/graphite slurry will depend on, among other factors, the amount of graphite present in the slurry. Where an ionic liquid-based electrolyte is used, the electrolyte has a viscosity between about 10 and 100 centipoise, without taking the carbon particles into account. In certain implementations the viscosity of the ionic liquid may be between about 10 and 50 centipoise. Further, the density of the electrolyte is typically less than that of nonporous graphite particles. In some embodiments, carbon particles are up to about 20% more dense than the electrolyte.

In many embodiments, the flow of electrolyte at the surface of the electrode is laminar during deposition. In other implementations, the flow of electrolyte is laminar during a substantial portion of the deposition process, and a turbulent electrolyte flow is used periodically to facilitate removal of the electrodeposited graphite. For instance, the flow rate of electrolyte may be periodically increased to produce a turbulent flow in which the shear stress of the fluid passing over the electrodeposited graphite has sufficient force to dislodge the graphite from the surface of the electrode. Turbulent flow may be introduced after a period of time has passed or at a particular frequency, or after the deposited graphite reaches a certain thickness. In some embodiments, a turbulent flow is introduced after between about 1 minute to 4 hours of deposition, for example after about 1 to 30 minutes, after about 30 to 60 minutes, or after about 1 to 2 hours of deposition. In certain implementations, a turbulent flow is introduced periodically, for example after about every 1 to 60 minutes, after about every 1 to 2 hours, or after about every 2-4 hours. In some embodiments, a turbulent flow is introduced after a certain amount of carbon is deposited, for example after about 1 to 100 millimeters of carbon are deposited, or after about 50 to 100 millimeters of carbon are deposited.

The timing of turbulent flow regime(s) should be such that the graphite may be removed without hindering the electrodeposition reaction. In certain implementations, the flow of electrolyte is turbulent only when the deposition reaction is not occurring. In other words, the flow of electrolyte is laminar during deposition, and after the reaction is substantially stopped, a turbulent electrolyte flow is used to help dislodge deposited graphite. The optimal timing of carbon removal will depend on various factors including, but not limited to the identity and flow rates of reagents and electrolyte, temperature, reactor configuration, power supplied, etc. Under typical conditions, graphite begins depositing within the first few minutes of the reaction, and the crystalline quality of the graphite improves as more graphite is deposited. As such, in certain implementations it is beneficial to allow the deposition to continue for relatively long periods of time (e.g., more than 30 minutes, more than 1 hour, more than 2 hours, or even longer in certain implementations) before the material is actively removed from the cathode surface.

V. Energy Consumption in the Reaction

1. Electrical Energy and Power to the Electrodes to Drive the Reactions.

The electrode and cell voltages are dictated by the thermodynamics, mass transport, and kinetics of the electrode reactions. Higher deposition rates tend to drive the electrode potential further apart. The electrical current employed in the reactor is a function of the rate of graphite generation (and other reaction products). In various implementations, the electrical energy requirements are comparable to those used for aluminum smelting reactors.

Any readily available source of electrical energy may be employed to power the electrochemical reactions. Electrical energy supplied from a municipal grid or from a local, sometimes dedicated, source may be employed. In certain embodiments, a fuel-cell is employed as a source of electrical energy to drive the electrochemical reaction of carbon oxide and/or carbonate to carbon. As is understood by those of skill in the art, a fuel cell will require a source of hydrogen. The hydrogen may be provided from a source of molecular hydrogen or from a hydrocarbon or other organic compound that is reformed at the fuel cell to produce hydrogen locally.

2. Heat Energy to Maintain High Temperature Reaction Conditions

Heat energy must be supplied to maintain the electrolyte in a suitable state, i.e., a molten state. A joule heater, heat exchanger, or other temperature control mechanism may be provided for this purpose.

In certain embodiments, heat energy is derived from the local environment, particularly if a combustion reaction is being used to generate the carbon dioxide. The heat content of the combustion gases may be extracted to a degree to help power the graphite reaction. In some implementations, heat energy (to maintain the electrolyte in a molten state, for example) is provided by coupling through heat exchange of existing industrial processes.

VI. Timing

The techniques described herein may be implemented in a continuous mode, a semi-continuous mode, or a batch mode. In the continuous mode, several operations may take place simultaneously and continuously. For example, electroplating may occur without interruption during extended production of graphitic material. In some cases, any two or more of the following operations occur continuously: reactant delivery, electroplating, scraping/material removal, and product separation. The mode of operation may be viewed from the perspective of a single cathode in, e.g., a multi-cathode system. In the semi-continuous mode, some or all of these operations may temporarily cease at some point during processing and then resume. As an example, electrolytic reduction at a cathode may temporarily cease while graphitic material is scraped from the cathode surface. In the batch mode, many of the operations occur sequentially and are performed on a specific batch of materials.

In the continuous mode of operation, reactants (e.g., a feed stream including $CO_2$) are constantly provided to the electrodes, and reaction products are constantly separated out from the electrolyte/carbon slurry. Power is continuously supplied to the electrode(s) such that electroplating happens continuously. Further, the removal of the electroplated material from the electrode(s) happens continuously. A particularly suitable removal mechanism in this case may be a scraper that is maintained at a fixed distance away from a rotating cathode, though other methods may be employed as well.

The semi-continuous mode of operation affords more flexibility compared to the continuous mode. In this implementation, there is generally a continuous supply of reactants, but some of the processes described above may temporarily cease during processing. For example, electroplating on a cathode may cease while electroplated material is removed from the electrode. In embodiments where there are multiple pairs of electrodes, electroplating on a first cathode may continue while electroplating on a second cathode temporarily ceases in order to remove material from the second cathode. In some implementations, electroplating is always taking place on at least one cathode of a multi-cathode system. While electroplating on one cathode is temporarily suspended during scraping/material removal, it continues on one or more other cathodes that are not being scraped or otherwise having material removed. In this way, graphitic material may be sequentially removed from individual electrodes. From the perspective of the reactor as a whole, this embodiment may be considered to use continuous electroplating. From the perspective of an individual cathode, this embodiment may be considered as semi-continuous electroplating.

In the batch mode of operation, delivery of reactants does not occur continuously. Instead, the reactants are generally introduced into the reaction chamber and allowed to react for a certain period of time. Although the electrolyte may be recycled through the recirculation/separation loop, no new $CO_2$ containing reactant feed is supplied after the initial batch is introduced to the reaction chamber.

VII. Process Flow Example

Turning to FIG. 1, a process 100 is depicted for producing graphite from carbon dioxide and/or carbonate. This process follows the path of carbon atoms from carbon oxide feedstock to isolated graphite product. Process 100 begins at block 103 as $CO_2$ feeds into the reactor. Ideally, the $CO_2$ feed is free of nitrous oxides and sulfuric oxides, and the proportion of $CO_2$ in the total feed is at least about 60 mole %. In certain embodiments, lower purity $CO_2$ feeds may be used. For example, where flue gas from a power plant is used, the $CO_2$ feed may be only about 5-15% $CO_2$. Where flue gas is used, it should be scrubbed of nitrous oxides and sulfuric oxides and concentrated to at least about 60 mole % before introduction into the reaction vessel. At block 105 the $CO_2$ dissolves in the electrolyte. Thereafter, at block 107 the $CO_2$ and/or carbonate ion present in the electrolyte are reduced to graphite and other products (e.g., soluble oxide anion and gaseous oxygen) at the cathode according to the principal cathode reactions:

$$CO_2+4e- \leftrightarrow C(s)+2O^{2-}, \text{ and}$$

$$CO_3^{2-}+4e- \leftrightarrow C(s)+3/2O_2 \text{ or } CO_3^{2-}+4e- \leftrightarrow C(s)+3O^{2-}$$

The carbonate may be replenished as $CO_2$ reacts with metal oxides or oxide anions to form more carbonate in the electrolyte according to the following reaction:

$$CO_2+O^{2-} \leftrightarrow CO_3^{2-}$$

Meanwhile, oxygen anion reacts at the anode to form elemental oxygen according to the anode reaction:

$$2O^{2-} \leftrightarrow O_2+4e-$$

Typically, though not necessarily, the evolved oxygen is substantially in vapor form and escapes through an outlet in the reactor.

At block 109 the graphite is dislodged from the electrode. This operation may be accomplished through vibration, scraping or other method as described herein. The dislodged graphite may form a slurry with the molten electrolyte. Depending on the relative densities of the components, the graphite may float, sink or stay suspended in the electrolyte. The electrolyte/graphite slurry then passes to a liquid-solid separator as indicated at block 111. The molten electrolyte is separated from the solid graphite, which is then rinsed as indicated at block 113. After the graphite is rinsed, it may generally be sold or processed for other uses. The separated electrolyte is generally fed through a recirculation loop back to the reaction vessel and/or an electrolyte reservoir.

VIII. Apparatus—Reactor Design

1. Overall System Design

The principal system components include an electrochemical cell and a recirculation loop for the electrolyte. The recirculation loop typically includes a pump for recirculating the electrolyte and a liquid/solid separator to extract graphite from the electrolyte circulated outside the cell. In other words, the liquid/solid separator and the pump are located outside of the electrochemical reactor. In some embodiments, the recirculation loop also includes a reservoir for the electrolyte.

Both the pump and the separator may be off the shelf components. In one example a slurry pump may be used. As the embodiments herein produce carbon particles in the range of 0.1 to 1000 microns in diameter or principal dimension, the separator chosen should be capable of separating particles of this size from liquid. Furthermore, the separator should be capable of withstanding the temperature of the molten electrolyte, which is typically between about 450-750° C., or even up to about 900° C. In some designs, the separator contains a filter component for separating particles in the size range of the graphite in the slurry. One example of a suitable liquid-solid separator for separating the graphite from the molten electrolyte is the I-SEP manufactured by Caltec Limited of Cranfield, Bedfordshire, United Kingdom.

Figure 2A:
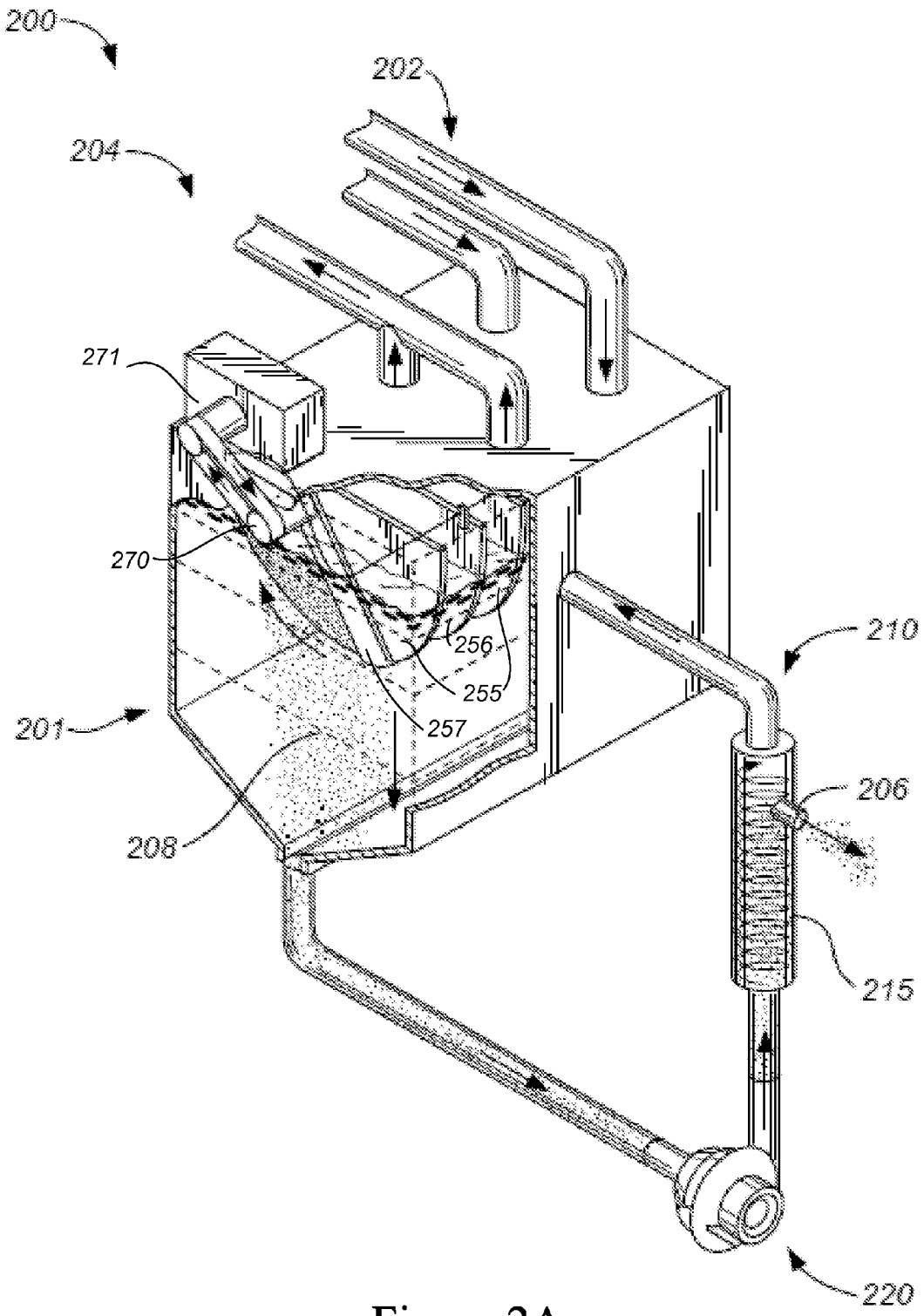
FIG. 2A shows a cutaway view of a reactor having multiple anodes and cathodes according to a disclosed embodiment.

FIG. 2A shows one example of an apparatus 200 for producing carbon from carbon oxide in accordance with the principles disclosed herein. The apparatus 200 may be used to produce, for example, graphite from carbon dioxide. The carbon oxide feedstock enters a reaction chamber 201 at an inlet 202. The reaction chamber further includes a series of anodes 256 and cathodes 255 in alternating positions. The carbon oxide and/or carbonate reduces at the cathodes 255 to form elemental carbon and soluble oxide anion and/or oxygen. The elemental carbon is removed from the cathode via scraper mechanisms 257 to form an electrolyte/carbon slurry 208. The scraper mechanism 257 may connect with a scraper axel 270, which rotates to move the scraper mechanism 257 along the surface of the cathode 255. The scraper axel 270 may control the position of any number of scraper mechanisms 257 connected to the particular axel. A single motor 271 may be used to control the position of a scraper axel 270 and any scraper mechanisms 257 attached thereto. The slurry 208 passes through a liquid-solid separator 215, where the elemental carbon is separated from the electrolyte. The carbon then exits through outlet 206, while the electrolyte is recirculated to the chamber 201 via a pump 220 and recirculation loop 210. The soluble oxide anion produced at the cathode reacts at the anode to form elemental oxygen, which exits the reaction chamber 201 at an outlet 204. The reactor design shown in FIG. 2A is scalable. The capacity of the reactor 200 may be increased by lengthening the chamber and adding additional electrodes 255 and 256 and scraper mechanisms 257.

Figure 2B:
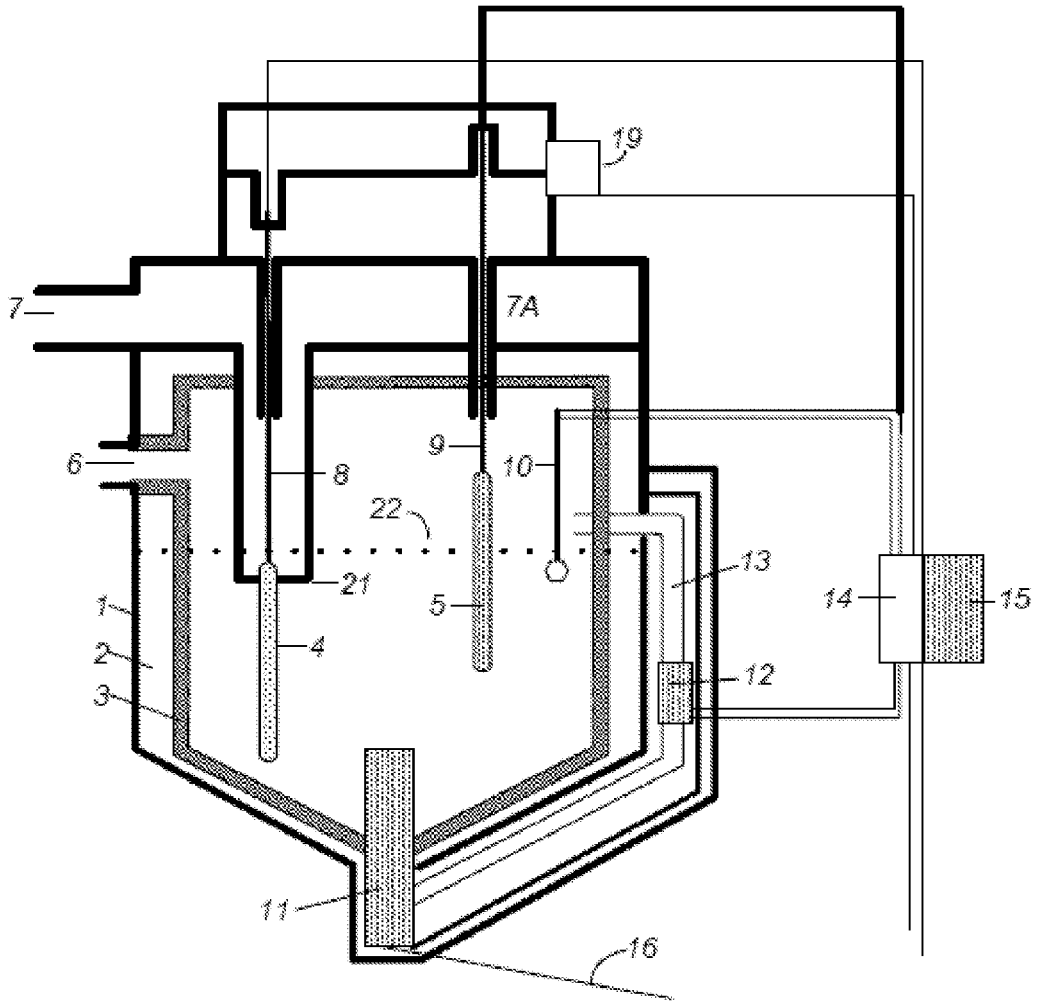
FIG. 2B shows a cross-sectional view of a reactor having a single anode and single cathode with a scraping mechanism that acts on the cathode according to one embodiment.

FIG. 2B is schematic depiction of an apparatus for producing elemental carbon from carbon oxide/carbonate. In this implementation, the reaction chamber comprises an outer container 1, insulation 2 and an inside bow 3. The inside bow may be made of any suitable material, including but not limited to ceramic. A carbon oxide feed stream (e.g., a stream of carbon dioxide) is fed into the reactor at inlet 6. The reaction chamber is filled with electrolyte up to the electrolyte fill line 22. The carbon oxide and/or carbonate are reduced at a cathode 5 to form elemental carbon, soluble oxide anion and oxygen. The oxide anion reacts at an anode 4 to form elemental oxygen, which flows through an oxygen evolution pathway 7A and exits the reaction chamber at an outlet 7. An additional exit pathway (not shown) may be used to allow oxygen generated at the cathode (which may be produced as carbonate reacts) to exit the reactor. Electrical leads 8 and 9 supply power to the anode 4 and cathode 5, respectively. In certain implementations, a motor 19 may be used, for example, to drive motion of one or more of the electrodes or other moving parts of the reactor.

After the elemental carbon forms on the cathode 5, it is removed from the cathode through the use of a carbon remover such as a scraper 21. In certain embodiments, graphitic material removal is performed at an elevated temperature, such that the material has a lower shear modulus and therefore is easier to remove. In some cases the elevated temperature is between about 400-900° C., for example between about 600-800° C. The removed carbon then mixes with the electrolyte to form a slurry. The slurry passes through a liquid-solid separator 11 to separate the carbon and electrolyte, and the carbon exits via a graphite recovery mechanism 16 such as a conveyor belt or other mechanism to move the carbon. The separated electrolyte is recycled through a recirculation loop 13. The electrolyte flow is powered by a pump 12, which in this embodiment acts on the recirculation loop 13. A fuse box 14 provides power to the pump and the electrical leads 8 and 9 connected with the anode 4 and cathode 5, and potentially to other components in the apparatus. One or more gauges 10 may be employed to monitor the temperature, pressure, or other conditions present in the reaction chamber or elsewhere in the apparatus. A controller 15 may be connected with various components in the apparatus, and can be designed or configured to monitor sensor outputs and control various aspects of the reaction. For example, the controller 15 may control the amount of carbon oxide which enters the reaction chamber, the amount of current or voltage supplied to the anode and/or cathode, the rate of removal of carbon, the power delivered to the pump, etc. The controller may be configured to control these and other variables in order to fine tune the reaction to obtain elemental carbon with desired properties.

Figure 2C:
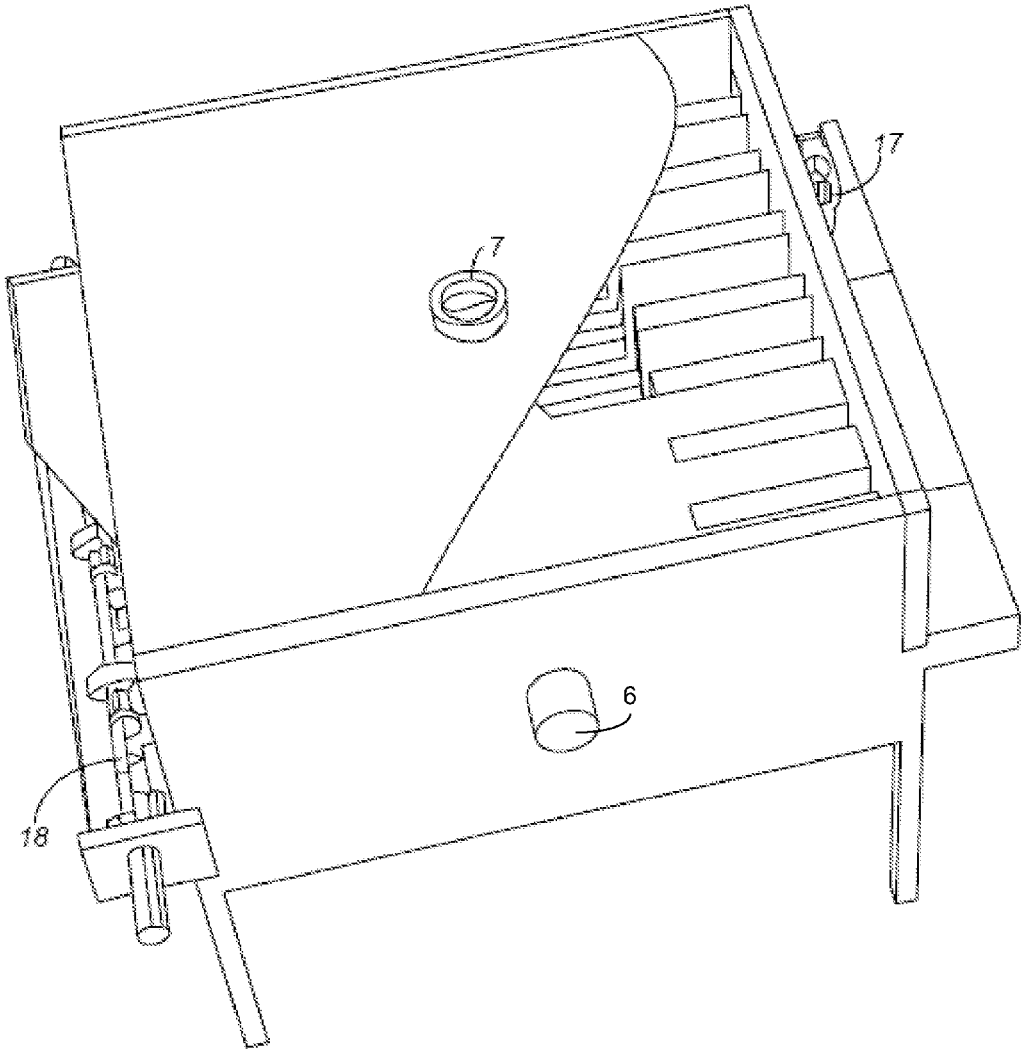
FIG. 2C shows a cutaway view of a reactor having multiple anodes and cathodes and a cam-shaft element for moving the electrodes.

FIG. 2C shows a cutaway view of an example embodiment using multiple reaction chambers, each reaction chamber having its own anode and cathode. Therefore, each reaction chamber is a separate electrochemical cell. In some implementations, the anodes and cathodes are shared between adjacent chambers. The electrodes in such designs are termed bipolar. The reaction chambers may be substantially sealed off from one another, or they may be fairly open to permit flow of electrolyte therebetween.

A feed stream enters at inlet 6. Each reaction chamber may have a hood configuration which allows the evolved oxygen to escape from the chambers and leave the apparatus at outlet 7. This embodiment further includes a cam shaft element 18 and an associated spring element 17 which operate to move the cathode in order to remove the deposited carbon and to reduce the voltage drop in the electrolyte. In some implementations, the anode and/or cathode may be moved by the cam shaft element 18 in order to dislodge elemental oxygen bubbles and thereby reduce the voltage drop in the electrolyte. These elements will be discussed in more detail below.

Figure 2D:
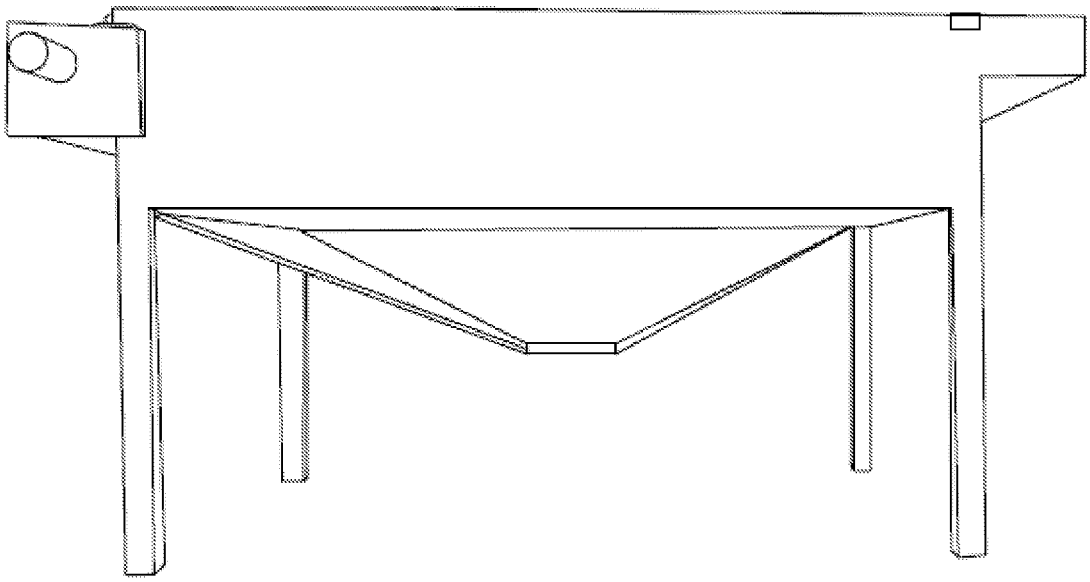
FIG. 2D shows an alternate view of the reactor shown in FIG. 2C.

FIG. 2D shows a side view of the embodiment depicted in FIG. 2C. FIG. 2D shows that the bottom of the apparatus may have one or more sloped surfaces, which may be beneficial in directing the flow of electrolyte and elemental carbon in the apparatus. A liquid-solid separator and/or pump (not shown) may be connected with the lowest portion of the sloped bottom in certain implementations.

Figure 2E:
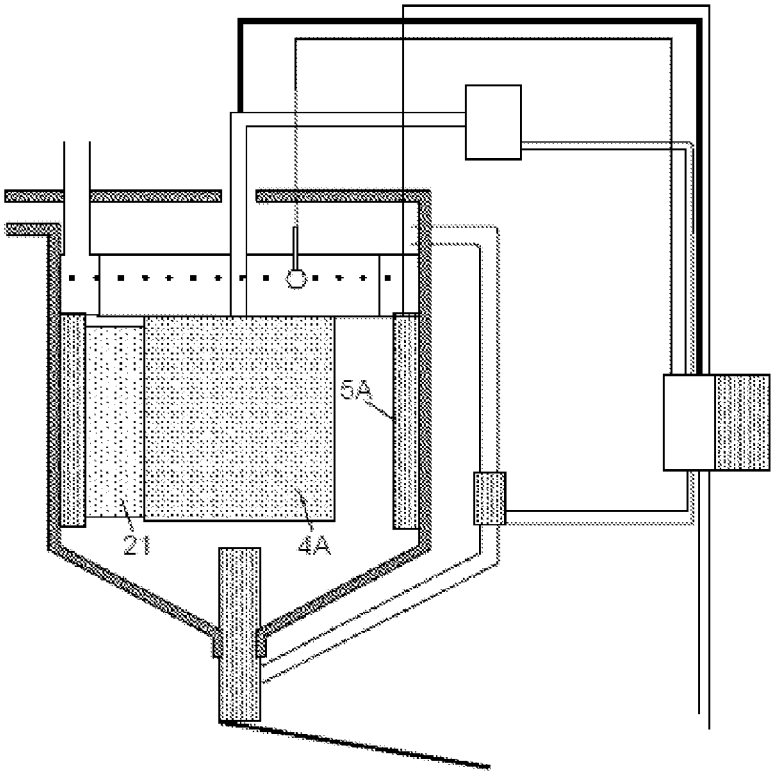
FIG. 2E shows a cross-sectional view of a reactor having a hollow cylindrically shaped anode, together with a centrally located cathode and a scraper according to one embodiment.
Figure 2F:
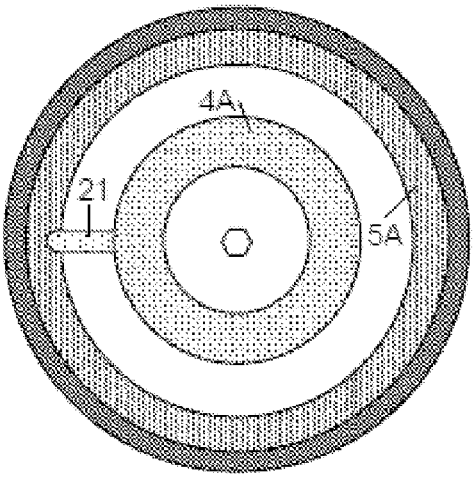
FIG. 2F shows a top down view of the interior of the reactor shown in FIG. 2E.

FIG. 2E shows a cross-sectional view of an embodiment of the reactor. In this implementation, the cathode 4A is radially located in the center of the reactor, and the anode 5A is a hollow-cylinder-shaped electrode positioned on the inside periphery of the reactor. As graphite builds up on the cathode 4A, the scraper mechanism 21 scrapes graphite off the cathode 4A and into the electrolyte. FIG. 2F shows a top down view of this embodiment of the reactor. Specifically illustrated in FIG. 2F are the cathode 4A, the anode 5A and the scraper mechanism 21.

Figure 2G:
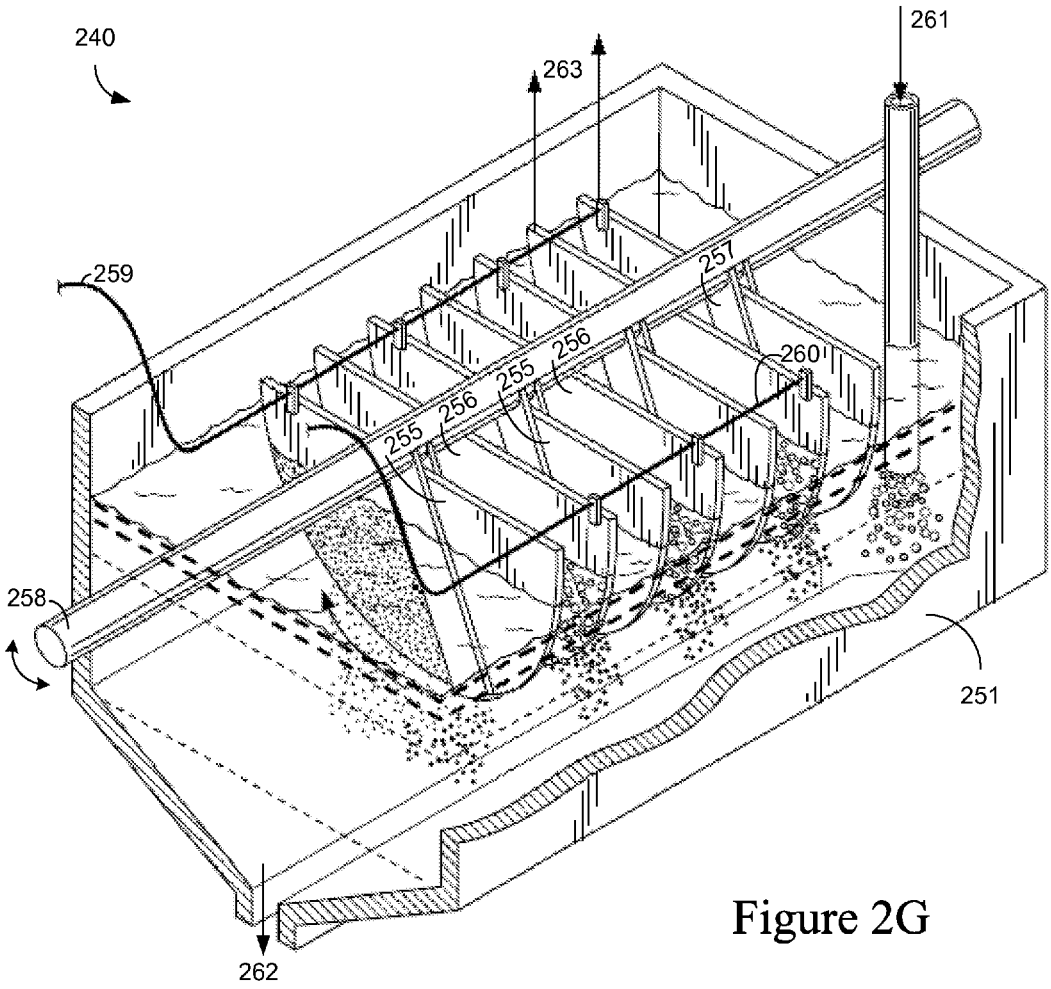
FIG. 2G shows a cutaway view of a reactor having multiple anodes and cathodes alternately positioned in a reaction chamber, with a scraper mechanism that simultaneously acts on each of the cathodes.
Figure 2H:
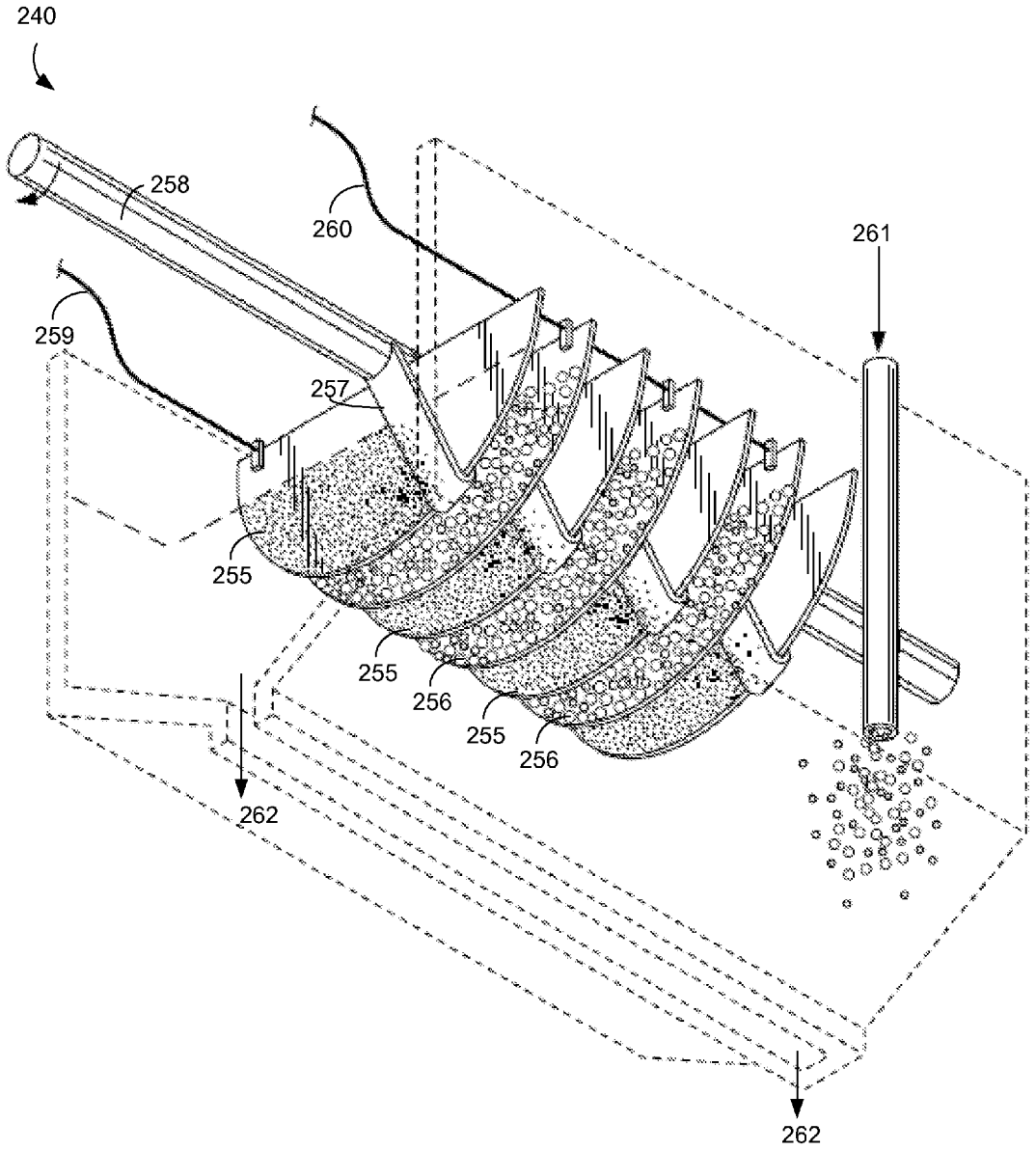
FIG. 2H shows a cutaway view of the reactor shown in FIG. 2G, as seen from below the reactor.

FIGS. 2G-H show more detailed cutaway views of an embodiment of the reactor 240. FIG. 2G shows the reactor from a perspective that is above and to the side of the reactor. FIG. 2H shows the reactor from a perspective that is below and to the side of the reactor. This embodiment is similar to the embodiment shown in FIGS. 2A and 2C-D in that the reactor 240 includes a series of repeating cathodes 255 and anodes 256 surrounded by reaction chamber walls 251. In this embodiment, the cathodes 255 and anodes 256 are shaped as semi-circular plates. A scraper mechanism 257 is configured to wrap around each cathode 255. Each scraper mechanism 257 is connected to a rotating rod 258. As the rod 258 rotates, the scraper mechanisms 257 scrape the surfaces of the cathodes 255 to dislodge the graphitic material built up at the cathodes 255. In FIGS. 2G-H, the righthand side of each cathode 255 is shown as a bare surface, indicating that the scraper has just finished scraping this portion of the cathode surface. The lefthand side is shown covered in solid black dots indicating the graphitic material that is yet to be scraped off. The anodes 256 are shown covered in hollow dots indicating bubbles. These bubbles correspond to gas generated at the anodes 256. Electrical connections 259 and 260 are used to connect the electrodes with a power supply (not shown). One electrical connection 259 connects to each of the cathodes, while another electrical connection 260 connects to each of the anodes. Reactants may enter the reaction chamber through inlet 261, and the graphitic slurry mixture leaves the reaction chamber through outlet 262, which extends linearly along the bottom of the reaction chamber. Upward-pointing arrows 263 indicates the removal of gaseous oxygen from the reaction chamber. The oxygen may be removed through an outlet port (not shown). The reactor 240 operates according to the principles described herein.

Figure 2I:
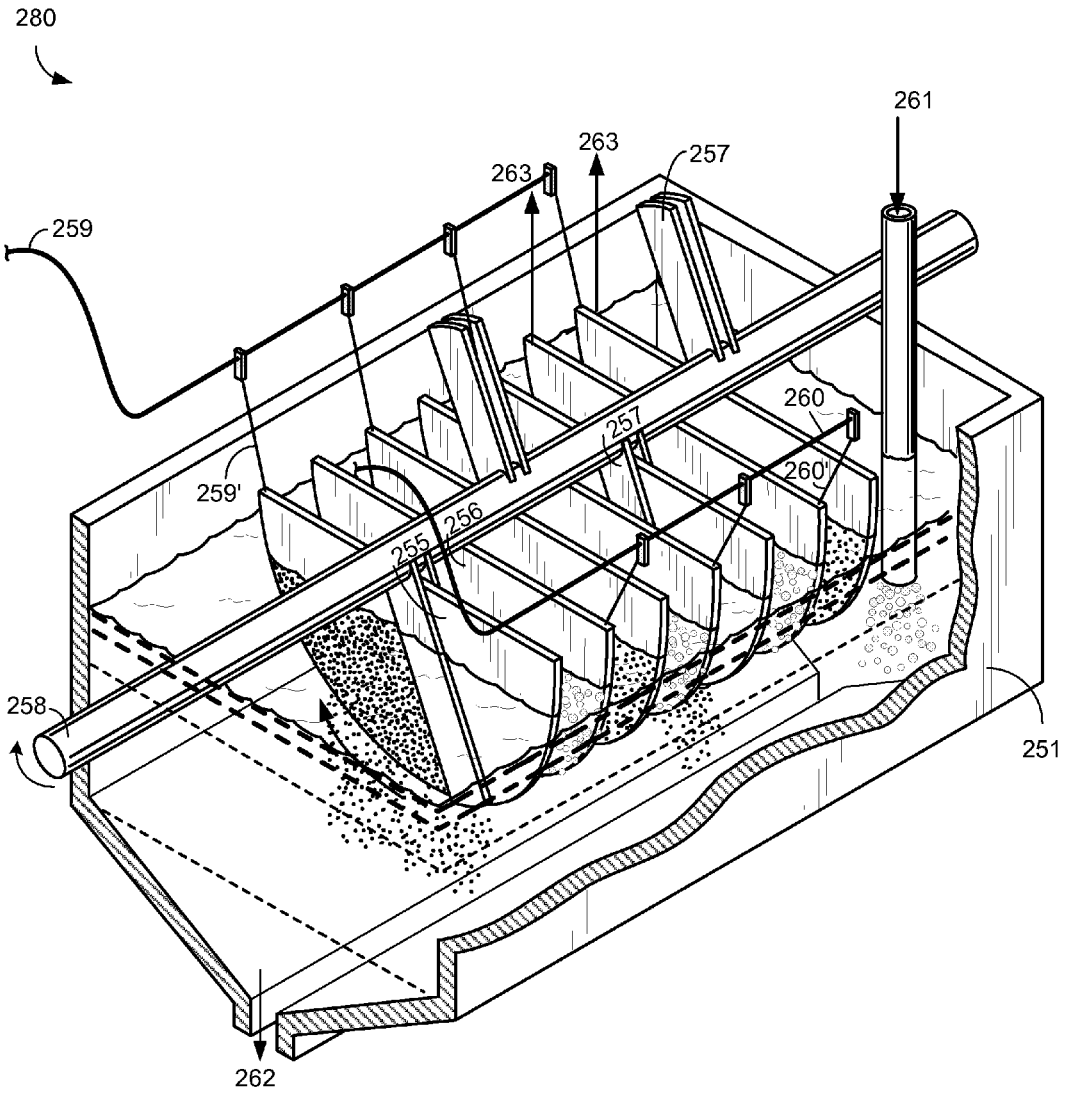
FIG. 2I shows a reactor having staggered scraping mechanisms.

FIG. 2I shows an embodiment of a reactor 280 where the scraper mechanisms 257 are radially staggered along a particular scraper axel 258, such that the scraper mechanisms 257 are angularly offset from one another. In this way, the flow of scraped carbon into the liquid-solid separator (not shown) may be more uniform over time. Where the scraper mechanisms 257 are not staggered, the liquid-solid separator may receive cyclic surges of scraped carbon. In this embodiment, additional electrical connections, 259' and 260' connect the cathodes with electrical connection 259 and the anodes with electrical connection 260, respectively. This configuration provides adequate space for the staggered scraper mechanisms 257 to rotate in the reaction chamber without interfering with the electrical connections 259 and 260. Notably, the additional electrical connections 259' and 260' may be oriented such that they fit between the arms of a scraper mechanism, as shown in FIG. 2I. Another difference between this embodiment and that shown in FIG. 2H, for example, is that each scraper mechanisms shown in FIG. 2I includes two straight arms, rather than a single u-shaped arm. In other words, the end of the scraper mechanism 257 opposite the axel 258 in FIG. 2I is open, while this same end is wrapped around/closed in FIG. 2G.

Not shown in FIGS. 2A-2I is a heating element to maintain the electrolyte at a desired temperature (e.g., about 500-900° C.). In some embodiments, a joule heater is employed for this purpose. Other sources of heat such as exhaust from combustion reactions may be employed. Also not shown in the figures is a reservoir for holding the electrolyte that is pumped and circulated through the electrochemical cell. The reservoir may be located in the recirculation loop shown in FIGS. 2A and 2B.

The optimal distance between the cathode and anode in each reaction chamber (the "cathode-anode separation") depends on various factors including, but not limited to, the reactor size, the fluid transport properties of the electrolyte, and the graphite removal mechanism employed. The cathode-anode separation should be kept at a distance that minimizes the voltage drop across the electrolyte while maintaining optimal removal of graphite from the cathode. In certain embodiments, the cathode-anode separation in each reaction chamber is between about 1 and 50 millimeters. The cathode-anode separation will generally be wider where the carbon is removed via a scraper mechanism as opposed to a vibrating mechanism.

The overall dimensions of the reactor are flexible, and should be chosen based on, among other factors, the desired throughput of the reactor. In certain implementations, the reactor may be between about 1-3 meters long in its principal direction. In other embodiments, the reactor may be smaller or larger than this range.

Figure 3A:
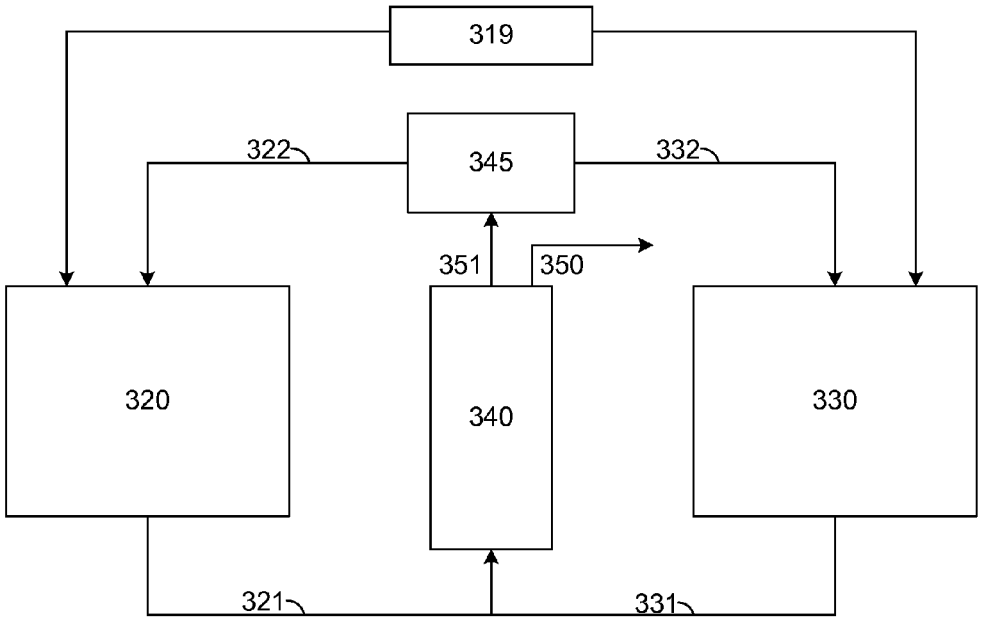
FIGS. 3A-3B show a block diagrams of multi-reactor systems.

FIG. 3A shows a high level block diagram of a multi-reactor system. Various details have been omitted for the sake of clarity. In this configuration, multiple plating cells 320 and 330 share certain elements such as a carbon oxide feed source 319, a liquid-solid separator 340, and an electrolyte reservoir 345. The feed source 319 provides carbon oxide material to each of the reactors 320 and 330. After carbon is deposited on and scraped from the surface of the cathodes (not shown) in the reactors 320 and 330, the carbon-electrolyte slurry exits through conduits 321 and 331, respectively, which deliver the slurry to the liquid-solid separator 340. The separated solid carbon exits at outlet 350 and continues on for further processing, as needed. The separated electrolyte exits at outlet 351, and then may be delivered to a holding tank 345, which in some embodiments may be heated. From the holding tank 345, electrolyte returns to the reactors 320 and 330 through conduits 322 and 332, respectively. The number of reactors that may be coupled to a single separator depends on the throughput of the reactors and separator. In some embodiments, the number of reactors sharing a separator may be greater than two.

Figure 3B:
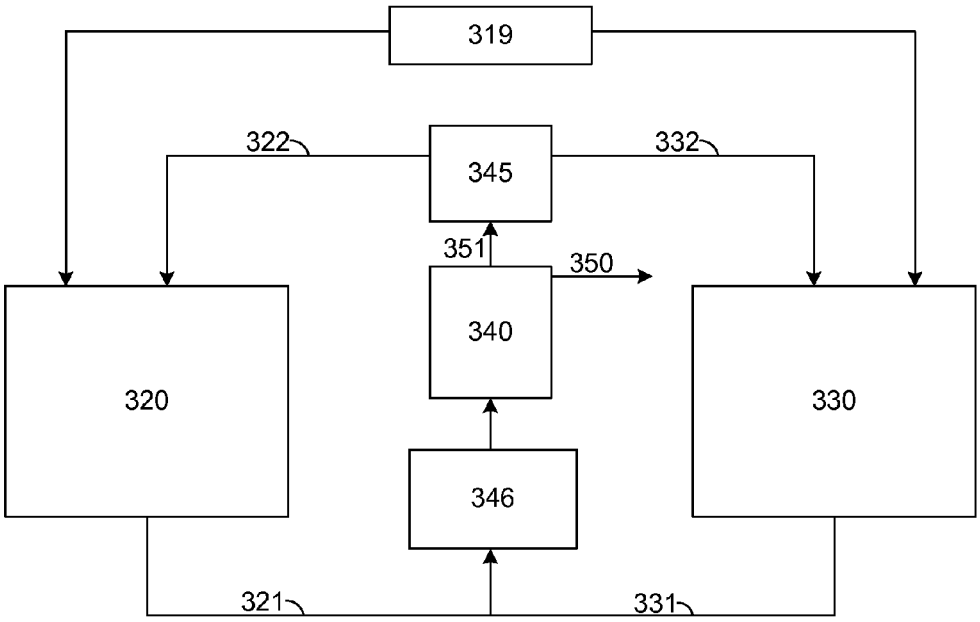

FIG. 3B shows an alternative multi-reactor system arrangement. In this configuration, the slurry exiting the reactors 320 and 330 through conduits 321 and 331, respectively, is fed into a slurry holding tank 346, which may be heated. The slurry is then fed to the liquid-solid separator 340. The separated solid carbon exits the separator at outlet 350, and the clean electrolyte exits the separator at outlet 351. The clean electrolyte may be fed into an electrolyte reservoir 345, and then back into the reactors 320 and 330 through conduits 322 and 332, respectively. This arrangement may be beneficial in providing slurry to the separator at a more uniform rate.

One advantage to using multiple reactors coupled with a single separator is that this configuration allows for simplified scaling. It is relatively easy to attach multiple reactors to a single separator. Further, it is relatively easy to attach additional reactors to a separator, even after a system is implemented. Thus, if a user desires to increase throughput beyond their current reactor capacity, they can simply attach additional reactors as needed. This also allows for efficient use of space, as users can design systems which fit their available workspaces. Further, it allows for efficient use of capital, as users can scale their operations as necessary.

Electrolyte storage tanks and/or slurry storage tanks may be implemented in single reactor as well as multi-reactor systems. In some cases, the storage tanks may be configured to hold "hot" electrolyte, which is typically for immediate use (e.g., for recirculation into a reactor). The storage tanks may also be configured to hold "cold" electrolyte, for example in a silo which is physically separated from the reactor by some distance. Typically, silos are used where the electrolyte/slurry will be used at some later time. Additionally, separation of carbon from the carbon-electrolyte slurry may occur at a location which is separated from the reactor by some distance. In some cases, for example, the reactor or reactors may be located in a first room or first building, and the separator is located in a second room or second building. Optimal placement of the apparatus components depends upon the space available, whether and where storage tanks are used, where the separated graphite is used, energy considerations, etc. For example, a holding furnace, where used, should be kept at a reasonable distance from the electrochemical cell. Design considerations include minimizing the amount of heat that must be added/captured to maintain the electrolyte in a molten state, as well as capital costs associated with construction and maintenance of the reactor/plant, and cost considerations relating to service/repair of individual system components.

Various aspects of the apparatus design may utilize conventional features used in the smelting aluminum industry or in other high temperature, high-reaction rate electrochemical processes known in the art.

2. Cathode Structure and Construction

The materials from which a cathode is constructed should resist degradation at the temperature and electrochemical conditions of operation. Examples include titanium, stainless steel, graphite and silver. Other materials that may be suitable in some implementations include gold and platinum. In certain embodiments, the cathode may be made of an alloy containing one or more of the listed materials. In all cases, the electrode material may be made of solid bulk material, or may be porous. In some embodiments, the electrode material contains nano-scale materials, particularly on a surface exposed to electrolyte.

In some implementations, the cathode surface is designed to facilitate the electrochemical reduction of carbon oxide and/or carbonate to form elemental carbon, particularly graphite. In some implementations, the cathode is designed to improve the kinetics of the electroreduction reaction. The surface condition may bias the formation of graphite or other desired material by making the deposition reaction of such material kinetically favorable. Also, as explained above, the surface condition may provide a template for deposition of graphite or other desired form of carbon. As mentioned, the cathode surface may contain a carbide or graphite itself, and may have a rough and/or patterned surface to promote graphite formation. Any material that promotes a high-quality graphite deposit may be used. Further, as mentioned above, the cathode may incorporate a gas diffusion mechanism to help promote the diffusion of $CO_2$ to the surface of the cathode where it is consumed. The gas diffusion mechanism increases mass transfer to the cathode and thereby allows the deposition reaction to proceed at a relatively high rate.

In certain embodiments the gas diffusion mechanism is a gas diffusion electrode. In other embodiments, there is a gas diffusion system that is used in conjunction with the cathode. In implementations using a gas diffusion electrode, $CO_2$ enters into the porous gas diffusion cathode and diffuses into the active cathode surface where it is reduced to form graphite. This component may significantly increase delivery of $CO_2$ to the cathode and thereby increase the rate of formation of graphite.

The cathode will typically have a structure that allows solid graphite to be separated from the body of the electrode where it deposits.

In one approach, the cathode electrode is vibrated at its resonance frequency or near resonance to drive off graphite that is electrochemically generated at and attached to the cathode. A related or overlapping technique is sonication. The graphite that detaches from the electrode is then suspended in the electrolyte as a slurry and must be removed from the liquid electrolyte. A liquid-solid separator may be used for this purpose.

The resonance frequency of the electrode is a function of the electrode material and physical dimensions. The resonance frequency further depends on the fluid in which the electrode is immersed. By vibrating the cathode at its resonance frequency (or at approximately its resonance frequency, e.g., within about 5%, or within about 10% of the resonance frequency), the amplitude of vibration may be maximized, thus producing good graphite removal results. In some implementations the cathode may be mechanically coupled to an oscillator tuned to the resonance frequency of the cathode. In certain cases, however, such motion will not produce significantly large displacements due to the motion of the cathode being dampened by the electrolyte. This damping may be an especially important consideration where a highly viscous electrolyte is used.

In one exemplary implementation, the cathode is a stainless steel cathode 100 centimeters long, 10 centimeters wide and 1 centimeter thick. In a vacuum, this cathode (acting as a cantilever) has a resonance frequency of about 8 Hz. In a typical molten carbonate electrolyte, the resonance frequency decreases according to Sader's Theory to about 5 Hz.

In another implementation, the cathode is a stainless steel cathode 50 centimeters long, 20 centimeters wide and 1 centimeter thick. In a vacuum, this cathode (acting as a cantilever) has a resonance frequency of about 33 Hz. In a typical molten carbonate electrolyte, the resonance frequency of the cathode decreases to about 15 Hz.

In an alternative implementation, the cathode itself may move back and forth to dislodge graphite from the surface of the cathode. In certain cases the cathode may move up and down, along a z-axis normal to the surface of the electrolyte. In other cases the cathode may move laterally along the longitudinal axis of the cathode. Such motion can be driven by fixing the cathode to a cam that drives the motion by use of an external circuit. Further details regarding the cam configuration are described below. In such implementations, part of top of the cathode may need to be electrically isolated from rest of the cathode in order to prevent a short circuit. The velocity of the cathode as it moves back and forth may be between about 2-50 cm/s, between about 10-45 cm/s, or between about 15-30 cm/s. Although this implementation consumes electrical power by driving the cam, it may reduce the overall energy footprint of the process.

In another approach, a scraper is used to mechanically scrape the surface of the electrode to remove the graphite that is deposited thereon. In some cases, the electrode or the scraper will rotate with respect to the other one in order to provide a fresh cathode surface for graphite deposition. While in certain embodiments the rotation is continuous, providing a consistently fresh cathode surface, in other embodiments the rotation is periodic. In some implementations, a blade for scraping the surface is maintained a fixed distance (e.g., between about 1 and 50 mm, between about 10 and 50 mm, or between about 25-50 mm) from the electrode surface, so that only the freshly deposited carbon is scraped from the surface. In these implementations, a layer of relatively permanent graphite remains on the cathode surface and is not removed by the scraper. In some embodiments, the scraper and cathode move relative to one another but do not rotate. For example, in one embodiment the cathode is a vertical cylindrical electrode and the scraper is a hollow disc-shaped scraper that fits around (or partially around) the cathode. The scraper may move vertically along the cathode's axis of rotation, thereby scraping off deposited carbon as the scraper contacts the surface of the cathode. Similarly, the scraper may have a fixed position and the cathode may move vertically such that the deposited carbon is scraped off by the scraper as the cathode moves. In certain embodiments, a motor may be used to drive the motion of the scraper and/or cathode and/or anode.

Regardless of the approach employed to remove the carbon from the surface, the removal may be applied continuously or intermittently. Where intermittent removal is used, the quality of graphite produced at a given time may affect the optimal removal frequency. The quality of graphite produced may vary over the course of deposition. For example, in some implementations the graphite may generally increase in quality (e.g., have a higher crystallite height) as more graphite is deposited. As such, where periodic graphite removal techniques are employed, it may be beneficial to have relatively longer times between graphite removal operations. However, the graphite should be removed before it becomes so thick as to impair the graphite removal process. In certain implementations, the quality of graphite may decrease over time, or may begin to decrease after a threshold time or graphite thickness is reached. In such cases, the graphite should be removed before the quality of graphite reaches below a desired level. In implementations where graphite removal is periodic, such removal may occur after about every 1 to 60 minutes, after about every 1 to 2 hours, or after about every 2-4 hours.

Figure 4A:
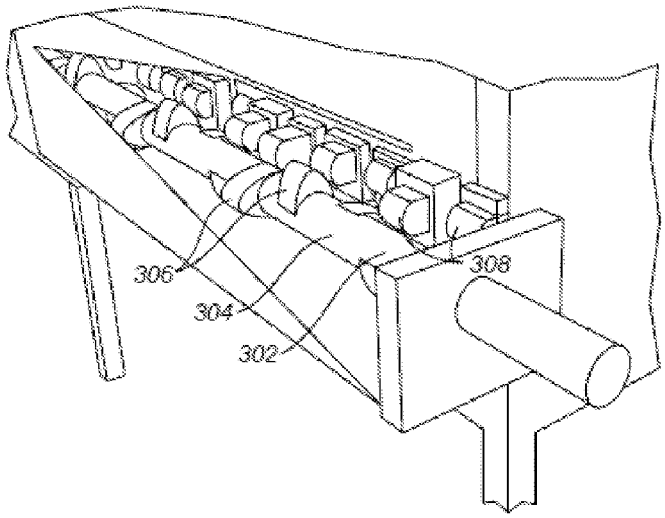
FIG. 4A shows a closeup view of the cam shaft element shown in FIG. 2C.
Figure 4B:
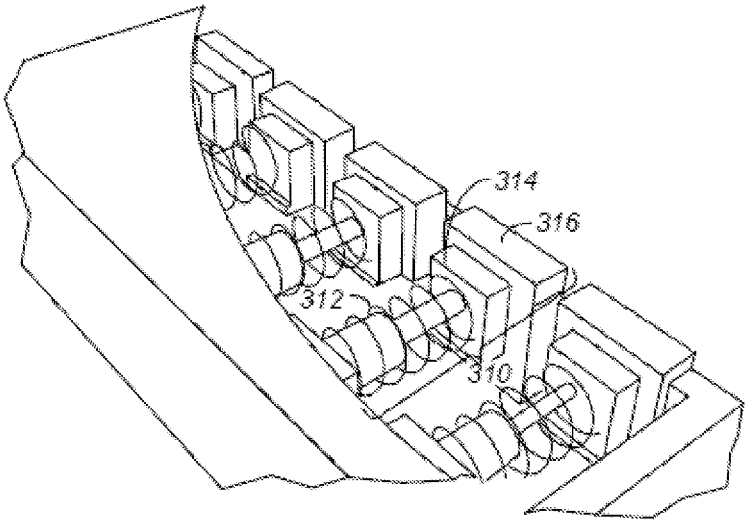
FIG. 4B shows a closeup view of a spring mechanism that interacts with the cam shaft element shown in FIG. 2C.
Figure 4C:
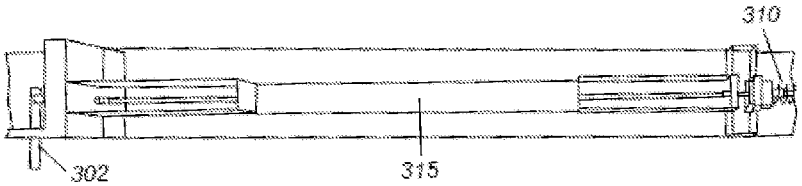
FIG. 4C shows a top-down view of a cathode configured to be moved by a cam shaft element and spring mechanism according to a disclosed embodiment.

FIGS. 4A-4C show various aspects of an embodiment where a cam shaft is used to vibrate the cathodes to promote dislodging of the graphite by shear force with the electrolyte. FIG. 4A shows the cam shaft element 302. The cam shaft element 302 includes a rotating rod 304 with cam shaft lobes 306, which interact with pushrods 308. As the cam shaft element 302 rotates, the cam lobes 306 engage with the pushrods 308 to push an associated cathode a distance away from the cam shaft element 302. FIG. 4B shows a spring configuration 310 which is associated with the cam shaft element 302 shown in FIG. 4A. The spring configuration 310 may include a spring 312, as well as a bumper 314 and a rubber seal 316. The rubber seal 316 helps seal the spring configuration away from the reaction chamber. In certain embodiments, a bellows is used to allow the pushrod and/or translation mechanism to move with respect to the apparatus chamber walls without leaking electrolyte. The bumper 314 engages with the spring 312 to allow the cathode (not shown) to move back and forth. One example implementation of the cam shaft element 302 and the spring configuration 310 is shown in FIG. 4C, which depicts a top-down view of a single cathode that may be found in a multi-cathode apparatus. In this implementation, the cam shaft element 302 and the spring configuration 310 are positioned on opposite sides of the reaction chamber and engage with opposite ends of the cathode 315. In certain other implementations, the cam shaft element and the spring configuration may be positioned on the same side of the apparatus, while other implementations may omit these elements altogether. Furthermore, in certain embodiments the cam shaft element and spring configuration may be positioned such that they engage with one or more anodes (not shown). Moving the electrodes with the cam shaft element and associated spring configuration may be beneficial in dislodging oxygen or other bubbles from the electrodes to decrease resistivity and promote a rapid, uniform reaction.

3. Anode

As with the cathode, the anode materials of construction should resist degradation at the temperature and electrochemical environment of operation. The surface of the anode may contain a material that facilitates the conversion of oxide anion to oxygen. Such material may improve the kinetics of the oxidation reaction.

In one implementation, the anode is made of (or coated with) nickel. The nickel material provides good resistance to degradation under alkaline conditions. A layer of nickel oxide (NiO) may form on the surface of the electrode. It is believed that the layer of nickel oxide will not impair the function of the electrode, and may in fact act to protect the electrode. In other implementations, the anode may be made of (or coated with) iridium, platinum, titanium, lead dioxide on titanium, tin dioxide, or alloys including one or more of the listed materials. Various nickel-containing electrodes may be used, especially where the surface of the electrode is treated to favor the formation of oxygen. Many other anode compositions are possible, and the foregoing list is not intended to be limiting.

Figure 5A:
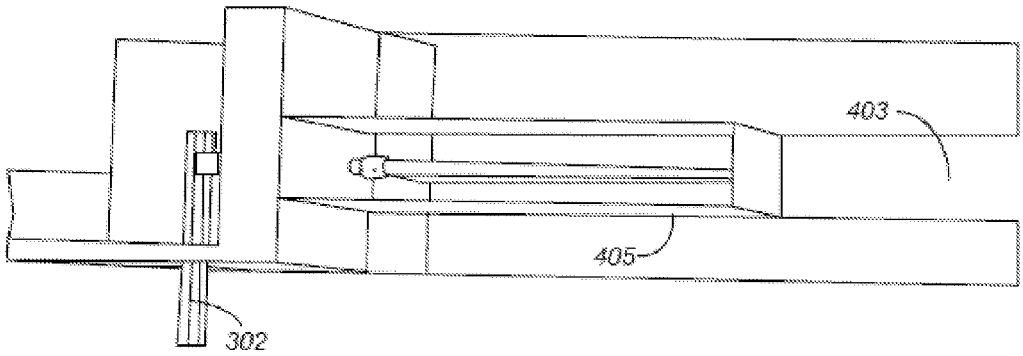
FIG. 5A depicts a hood mechanism that may be implemented over an anode or cathode to help direct the flow of evolved oxygen in certain embodiments.

FIG. 5A shows one implementation of a hood 403 which helps maintain the oxygen evolved at the anode separate from the incoming carbon oxide feed. The hood 403 fits over the anode to collect the oxygen evolved at the anode. In embodiments containing multiple anodes, there may be a separate hood for each anode, or there may be a single hood element designed to interact with each anode and collect the oxygen evolved therefrom. The hood 403 allows the evolved oxygen to remain separate from the incoming carbon oxide feed stream and includes at least one chimney 405 which allows the oxygen to exit the reaction chamber.

Figure 5B:
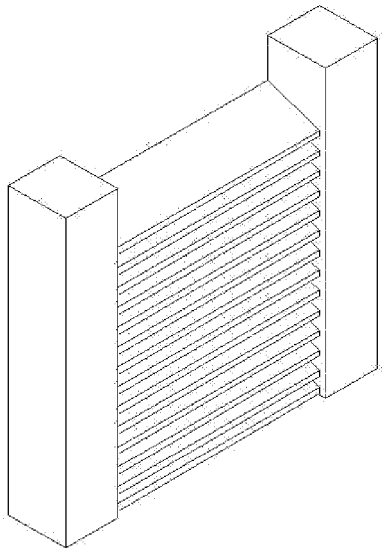
FIG. 5B shows an example of a louvered anode that may be used in certain embodiments to help promote removal of oxygen from the system.

The anode may be designed to minimize gas phase buildup on the surface of the anode. For example, in certain embodiments the anode may be coupled with a cam shaft 302 and spring configuration (not shown) which allow the anode to move back and forth to dislodge bubbles that may otherwise accumulate on the anode surface. Another method to promote efficient removal of oxygen from the anode is to use a louvered anode having slits to encourage the oxygen to escape the reaction chamber via a certain path. An example of a louvered anode is shown in FIG. 5B. Gas phase oxygen buildup at the anode is undesirable because the bubbles increase the resistivity of the system, meaning that there is a larger voltage drop and correspondingly slower plating at the cathode.

For example, gas evolution from smooth and flat electrodes has been observed for the anodic evolution of $O_2$, as in the case of zinc electrowinning plants where lead dioxide covered lead ($PbO_2$ covered Pb) anodes are used at high current densities, up to 500 mA/cm$^2$. Better performance is generally achieved by modifying the electrode to include slits or holes to assist the escape of gas bubbles towards the back of the electrode.

Figure 5C:
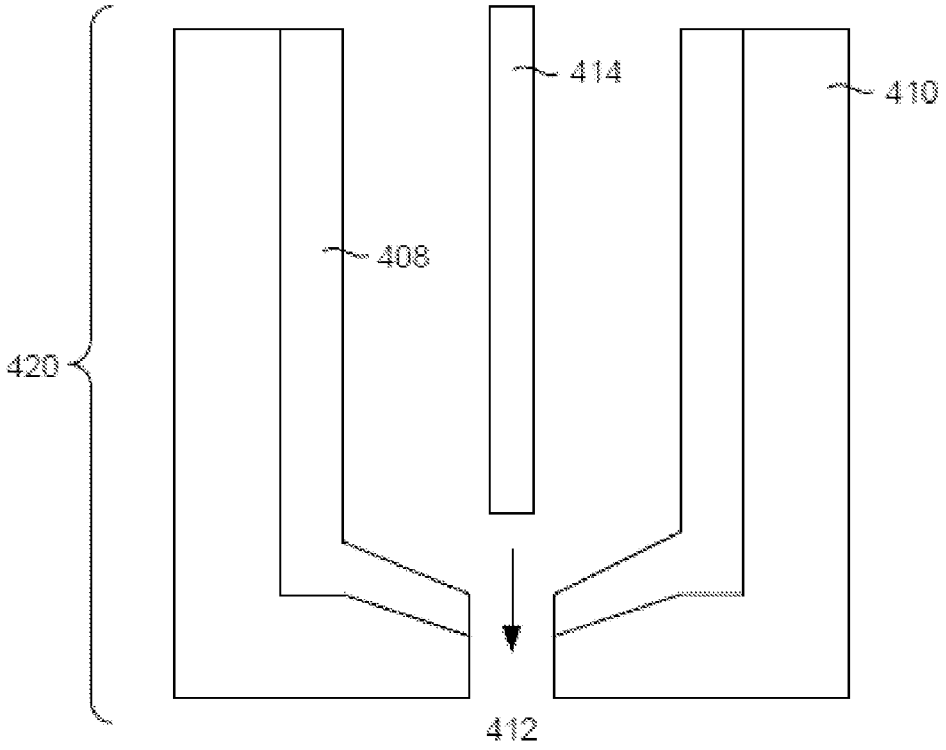
FIGS. 5C-5D illustrate reactor embodiments where the anode forms the inner surface of the reaction chamber. The reactor in FIG. 5C is radially symmetric, and electrolyte flows out from the bottom of the reactor. The reactor in FIG. 5D is radially asymmetric, and electrolyte flows over a lowered sidewall of the reactor.
Figure 5D:
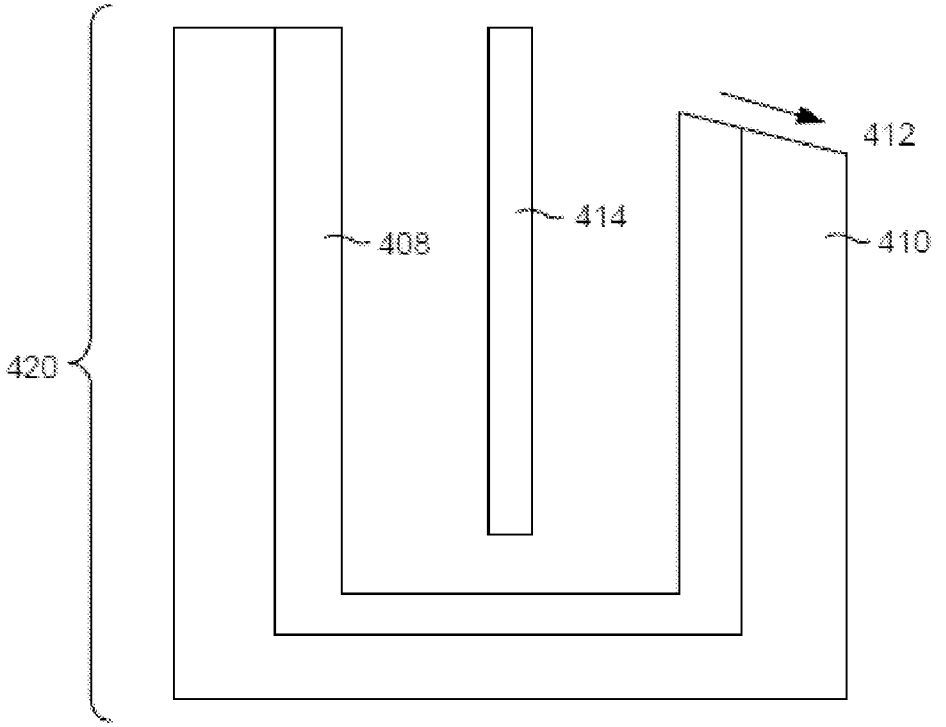

FIGS. 5C and 5D show cutaway views of alternative embodiments of a reaction vessel 420. In these embodiments, the reaction vessel 420 includes a vessel-shaped anode 408 surrounded by an insulator 410. The insulator may be made from ceramic or any other suitable material. The reaction vessel shown in FIG. 5C is radially symmetric and has an outlet 412 positioned at the bottom of the vessel. The inside surface of the reaction vessel 420 is the anode 408. The cathode 414 extends through the center of the vessel. The outlet 412 may connect with a liquid-solid separator, pump, or recirculation loop in certain embodiments. This type of reaction vessel design may be beneficial where the graphite or other product produced is about equally or more dense than the electrolyte used, as the dense product will tend to fall to the bottom of the vessel 420 after it is dislodged from the cathode 414. From there, it can exit via the outlet 412 at the bottom of the vessel 420. The reaction vessel shown in FIG. 5D is radially asymmetric and includes an outlet 412 positioned at a lowered side wall of the vessel 420. In this implementation, the electrolyte resides in the reaction vessel 420 in the space defined by the vessel-shaped anode 408. The cathode 414 extends through the center of the vessel. The level of electrolyte during operation is sufficiently high such that excess electrolyte spills over a lowered side wall and exits at outlet 412. As in the previous design, the outlet 412 may connect with a liquid-solid separator, pump or recirculation loop. This design may be beneficial where the graphite or other product produced is less dense than the electrolyte used, for example, where the graphite produced is particularly porous.

4. Electrochemical Cell Container and Other Containers

The electrochemical cell container (i.e., the reactor housing) must resist degradation by a high temperature molten electrolyte. Appropriate insulation and temperature resistant materials should be used in the construction. Examples of suitable materials include graphite, ceramics, alumina, composite materials, and similar materials that meet the mentioned requirements. In general, suitable materials of construction are those used in cells for aluminum smelting and certain other electrolytic processes employing molten salt electrolytes.

The size of the cell container is large enough to efficiently generate carbon at a high rate. In certain embodiments, the chamber has a nominal diameter (or other principal cross-sectional dimension) of about 1 to 3 meters.

In some embodiments, other containers are used in combination with the electrochemical cell container. For example, a storage container may be used to hold graphite/electrolyte slurry before the slurry is delivered to a separator. In another example, storage containers may be used to hold separated electrolyte and/or separated graphite after these materials leave a separator. These containers should likewise be made of a material that will withstand the high operating temperatures (e.g., 400-900° C.), and should also be resistant to corrosion. The materials recited above may be used to construct the electrochemical cell may also be used to construct these secondary containers.

5. Power Source

The power source employed to drive the electrochemical reactions will be designed or chosen to meet the requirements of the reactor size. For industrial processes, it may require currents of ~50 kA. In certain embodiments, there will be a control mechanism in place that uses active feedback of temperature through the use of a thermocouple or other temperature sensor. The control mechanism may control the cell voltage (potentiostatic or potentiodynamic control). In other implementations, the control mechanism may control the cell current (amperostatic or amperodynamic control). In some implementations, the controller will employ a control algorithm for delivering voltage or current to the electrodes of the cell. Such algorithm may employ pulsing, ramping, and/or holding the cell potential and/or current at particular stages of the electrochemical process.

In some embodiments, the power supply and control system (collectively a controller) includes a processor, chip, card, or board, or a combination of these, which includes logic for performing one or more control functions. Some functions of the controller may be combined in a single chip, for example, a programmable logic device (PLD) chip or field programmable gate array (FPGA), or similar logic. Such integrated circuits can combine logic, control, monitoring, and/or charging functions in a single programmable chip.

In general, the logic used to control the electrical potential and current provided to the electrodes and/or the mechanisms for circulating electrolyte and/or the mechanisms for dislodging graphite from the cathode can be designed or configured in hardware and/or software. In other words, the instructions for controlling the charge and discharge circuitry may be hard coded or provided as software. It may be said that the instructions are provided by "programming." Such programming is understood to include logic of any form including hard coded logic in digital signal processors and other devices which have specific algorithms implemented as hardware. Programming is also understood to include software or firmware instructions that may be executed on a general purpose processor. In some embodiments, instructions for controlling application of voltage to the batteries and loads are stored on a memory device associated with the controller or are provided over a network. Examples of suitable memory devices include semiconductor memory, magnetic memory, optical memory, and the like. The computer program code for controlling the applied voltage can be written in any conventional computer readable programming language such as assembly language, C, C++, and the like. Compiled object code or script is executed by the processor to perform the tasks identified in the program.

6. Contacts and Other Current Carrying Lines for the Electrodes

Bus bars and other power transmission structures will typically be employed to deliver electrical energy to the anode and cathode. As with various other aspects of the apparatus, industrial bus bar designs for smelting aluminum or for other high temperature, high-reaction rate electrochemical processes may be employed.

The foregoing describes certain presently preferred embodiments. Numerous modifications and variations in the practice of this invention will occur to those skilled in the art. Such modifications and variations are encompassed within the following claims. The entire disclosures of all references cited herein are incorporated by reference for all purposes.

IX. Graphite Production Process

This section will briefly summarize an exemplary embodiment of the disclosed techniques, specifically highlighting where certain reactions and processes occur. Processes that occur inside the reactor will be discussed first. The principal cathode reactions described above result in the formation of graphitic material as carbon dioxide and/or carbonate ion are reduced at the cathode surface. Also described above, one or more counter reactions result in the oxidation of oxide ion at the anode surface. The cathode reaction may produce highly crystalline graphite on the cathode, especially where the cathode surface includes a template for graphite formation. After the graphitic material is deposited to a sufficient height on the cathode, a graphite removal mechanism (e.g., a scraper or vibrator) is used to remove the graphitic deposit from the cathode. Material removal may be performed at a reactor temperature where the graphitic material is relatively ductile (e.g., more ductile than during the deposition process), and/or at a temperature where the shear modulus is lower.

At this point, the graphitic material may be in powderized form, dispersed in the electrolyte. The geometry of the reactor may assist in separating the graphitic material from the electrolyte. For example, where the graphitic material formed is more dense than the electrolyte, the reactor may have a sloped bottom with an outlet at the lowest point, as shown in FIGS. 2A, 2B, 2D, 2E, 2G, 2H and 5C. In this way, the dense graphitic material will tend to settle to the bottom of the reactor where it exits through the outlet as a relatively dense graphite-electrolyte mixture.

Certain processes may occur outside the reactor. For example, after the graphite-electrolyte mixture passes through the reactor outlet, the mixture may be pumped through a liquid-solid separator, which separates the molten electrolyte from the solid graphitic material. After exiting the liquid-solid separator, the electrolyte may be pumped back into the reactor to be reused via a recirculation loop, as illustrated in FIGS. 2A, 2B and 2E. The separated graphitic material may be fed into a secondary container for purification.

What is claimed is:

1. An apparatus for producing crystalline solid carbon from carbon dioxide, the apparatus comprising:

(a) an electrochemical cell comprising:

a cell chamber for holding a molten carbonate electrolyte during electrochemical reduction of carbon dioxide;

one or more cathode assemblies, each comprising a cathode and a mechanism for removing the crystalline solid carbon electrochemically deposited on the cathode, each cathode comprising a morphological template for forming the crystalline solid carbon with a crystallite height between about 50-500 nm, the morphological template comprising graphite or a carbide; and one or more anodes; and (b) a recirculation loop fluidically coupled to the electrochemical cell and comprising a pump for inducing flow of the electrolyte to and from the electrochemical cell via the recirculation loop; and (c) a liquid-solid separator for separating the crystalline solid carbon from the electrolyte.

2. The apparatus of claim 1, wherein at least one anode comprises side walls and a bottom that define a reaction space.

3. The apparatus of claim 1, wherein at least one anode comprises nickel, nickel oxide, rhodium, graphite, gold, stainless steel, titanium, platinum, tin oxide, or a combination thereof.

4. The apparatus of claim 1, wherein at least one anode comprises holes and/or slits in the anode to promote removal of evolved gas from the anode and out of the cell chamber.

5. The apparatus of claim 1, wherein the surface of at least one cathode is patterned.

6. The apparatus of claim 1, wherein at least one cathode is porous.

7. The apparatus of claim 1, wherein at least one cathode comprises a material from the group consisting of graphite, titanium, stainless steel, silver, gold, platinum, molybdenum, and a combination thereof.

8. The apparatus of claim 1, wherein the cathode is a gas diffusion electrode.

9. The apparatus of claim 1, wherein the mechanism for removing the crystalline solid carbon from the cathode comprises a vibration inducing mechanism for inducing the cathode to vibrate at approximately the resonance frequency of the cathode.

10. The apparatus of claim 1, wherein the mechanism for removing the crystalline solid carbon from the cathode comprises a vibration inducing mechanism for inducing the electrolyte to vibrate.

11. The apparatus of claim 1, wherein the mechanism for removing the crystalline solid carbon from the cathode comprises a scraper configured to scrape the crystalline solid carbon from the cathode.

12. The apparatus of claim 11, wherein the mechanism for removing the crystalline solid carbon from the cathode comprises a rotator configured to rotate the cathode while the scraper scrapes the crystalline solid carbon from the cathode.

13. The apparatus of claim 1, further comprising a power supply for delivering electrical power to at least one anode and/or at least one cathode to drive reduction of carbon dioxide to the crystalline solid carbon at the at least one cathode.

14. The apparatus of claim 1, wherein the recirculation loop further comprises an electrolyte reservoir.

15. The apparatus of claim 1, wherein a plurality of electrochemical cells are connected with the liquid-solid separator, each electrochemical cell as described in (a), and each electrochemical cell being provided in its own cell chamber.

16. The apparatus of claim 1, wherein the target level of crystallinity corresponds to a crystallite height between about 50-500 nm.

17. The apparatus of claim 16, wherein the target level of crystallinity corresponds to a crystallite height between about 150-300 nm.

18. The apparatus of claim 1, wherein the morphological template comprises carbide.

19. The apparatus of claim 18, wherein the carbide is selected from the group consisting of: titanium carbide, iron carbide, chromium carbide, manganese carbide, silicon carbide, nickel carbide, molybdenum carbide, and combinations thereof.

20. The apparatus of claim 1, wherein the morphological template is provided as a layer on a surface of the cathode, the layer having a thickness between about 1-500 nm.

21. The apparatus of claim 1, wherein a surface of the cathode has a surface roughness (Ra) between about 10-1000 micrometers.

22. The apparatus of claim 1, wherein the mechanism for removing the crystalline solid carbon electrolytically deposited on the cathode comprises a scraper, and wherein a distance between the cathode and the scraper is between about 1-50 mm.

23. The apparatus of claim 1, wherein a plurality of anodes and a plurality of cathode assemblies are provided in the cell chamber of the electrochemical cell.

24. The apparatus of claim 23, wherein the anodes and cathode assemblies are positioned within the electrochemical cell in an alternating manner such that most of the anodes are positioned between two cathode assemblies and most of the cathode assemblies are positioned between two anodes.

25. The apparatus of claim 24, further comprising one or more hoods positioned over the electrochemical cell, the hoods configured to capture gas that evolves at the anodes and permit removal of the evolved gas from the electrochemical cell.

26. The apparatus of claim 1, further comprising an inlet for introducing carbon dioxide directly into the molten carbonate electrolyte in the cell chamber.

27. The apparatus of claim 26, wherein the inlet bubbles the carbon dioxide directly into the molten carbonate electrolyte in the cell chamber.

28. The apparatus of claim 1, further comprising a controller configured to control the electrochemical reduction of carbon dioxide in a manner that forms graphite on the cathode.

29. The apparatus of claim 28, wherein the graphite comprises a crystallite height between about 50-500 nm.

30. The apparatus of claim 1, further comprising a gas diffusion system configured to deliver gas to the cathode.

31. The apparatus of claim 1, further comprising a controller configured to cause the mechanism for removing the crystalline solid carbon electrochemically deposited on the cathode to remove the crystalline solid from the cathode after about every 2-4 hours during operation.

32. The apparatus of claim 1, wherein the anode is louvered.

* * * * *